US010874590B1

(12) United States Patent
Butaud et al.

(10) Patent No.: US 10,874,590 B1
(45) Date of Patent: Dec. 29, 2020

(54) MEDICATION-DISPENSING SYSTEM AND METHOD

(71) Applicants: Wade M. Butaud, Spanish Fork, UT (US); Benjamin A. Grover, Phoenix, AZ (US); Kent F. Beck, Layton, UT (US); James A. Malmstrom, Kaysville, UT (US)

(72) Inventors: Wade M. Butaud, Spanish Fork, UT (US); Benjamin A. Grover, Phoenix, AZ (US); Kent F. Beck, Layton, UT (US); James A. Malmstrom, Kaysville, UT (US)

(73) Assignee: Butaud Enterprises LLC, Vernal, UT (US)

( * ) Notice: Subject to any disclaimer, the term of this patent is extended or adjusted under 35 U.S.C. 154(b) by 0 days.

(21) Appl. No.: 16/280,000

(22) Filed: Feb. 19, 2019

Related U.S. Application Data

(60) Provisional application No. 62/632,412, filed on Feb. 19, 2018.

(51) Int. Cl.

| | |
|---|---|
| ***A61J 1/03*** | (2006.01) |
| ***A61J 7/00*** | (2006.01) |
| ***A61J 7/04*** | (2006.01) |

(52) U.S. Cl.
CPC ..... *A61J 7/0076* (2013.01); *A61J 1/03* (2013.01); *A61J 7/0436* (2015.05); *A61J 2200/30* (2013.01)

(58) Field of Classification Search
CPC .... A61J 7/0046; A61J 2200/70; A61J 7/0076; A61J 7/04; A61J 7/0418
See application file for complete search history.

(56) References Cited

U.S. PATENT DOCUMENTS

| | | | | |
|---|---|---|---|---|
| 4,460,106 | A * | 7/1984 | Moulding, Jr. .... | B65D 83/0409 221/1 |
| 5,852,590 | A * | 12/1998 | de la Huerga ..... | A61J 7/0481 368/10 |
| 6,302,295 | B1 * | 10/2001 | Weisman ..... | A61J 1/03 221/188 |
| 6,545,592 | B2 * | 4/2003 | Weiner ..... | A61J 1/03 220/212 |
| 7,907,477 | B2 * | 3/2011 | Puzia ..... | A61J 7/0472 215/230 |

(Continued)

*Primary Examiner* — Gene O Crawford
*Assistant Examiner* — Ayodeji T Ojofeitimi
(74) *Attorney, Agent, or Firm* — Warren M. Pate; Pate Peterson, PLLC

(57) ABSTRACT

A method of dispensing a prescription medication is disclosed. The method may begin with obtaining a medication dispensing system. The system may include a prescription vial and a programmable cap for the prescription vial. The cap may include an outer cover having an exit aperture, an inner cover having an entrance aperture, and a transport portion having a chute. The cap may also include a control system having a processor. The method may include the step of determining, by the processor, that a first waiting period has passed. The control system may then dispense a first portion of the medication. The dispensing may involve sensing that a tablet or capsule of the medication is loaded into the chute and moving, by the control system, the chute of the transport portion out of alignment with the entrance aperture and into alignment with the exit aperture.

20 Claims, 23 Drawing Sheets

(56) References Cited

U.S. PATENT DOCUMENTS

| | | | | |
|---|---|---|---|---|
| 7,978,564 | B2 * | 7/2011 | De La Huerga | A61M 5/14212 221/15 |
| 9,730,860 | B2 * | 8/2017 | Hamilton | A61J 7/04 |
| 2005/0269348 | A1 * | 12/2005 | Limback | A47L 15/4409 221/263 |
| 2013/0116818 | A1 * | 5/2013 | Hamilton | A61J 7/04 700/236 |
| 2013/0200033 | A1 * | 8/2013 | Zonana | B65D 83/0409 215/231 |
| 2014/0074283 | A1 * | 3/2014 | Blackburn | A61J 7/0076 700/237 |
| 2019/0130078 | A1 * | 5/2019 | Herbert | G16H 20/13 |

* cited by examiner

MEDICATION-DISPENSING SYSTEM AND METHOD

RELATED APPLICATIONS

This application claims the benefit of U.S. Provisional Patent Application Ser. No. 62/632,412 filed Feb. 19, 2018, which is hereby incorporated by reference.

BACKGROUND

1. Field of the Invention

This invention relates to controlling access to prescription medication and, more particularly, to novel systems and methods for dispensing medication according to predefined schedules.

2. Background Art

Modern medicine has produced many different medications. While these medications accomplish significant good, some are potentially addictive, have negative side effects, or simply need to be limited in their use. For example, in the past century, our society has seen an increased use of medications for pain, anxiety, sleep, etc. Some patients misuse or abuse these medications in attempts to obtain a euphoric effect or to profit by selling their medication to others who would abuse or misuse that medication.

There have been efforts to ensure that the use of the medication is exactly as prescribed without the risk of abuse or misuse. Despite these efforts, a 2008 report by the Coalition Against Insurance Fraud estimates that the abuse of opioid analgesics alone results in more than $72 billion in medical costs each year. This figure does not account for all of the other types of controlled substances such as benzodiazepines and stimulants, which, if included, may result in more than $100 billion per year in medical costs. Accordingly, what is needed are improved systems and methods for controlling access to prescription medication.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
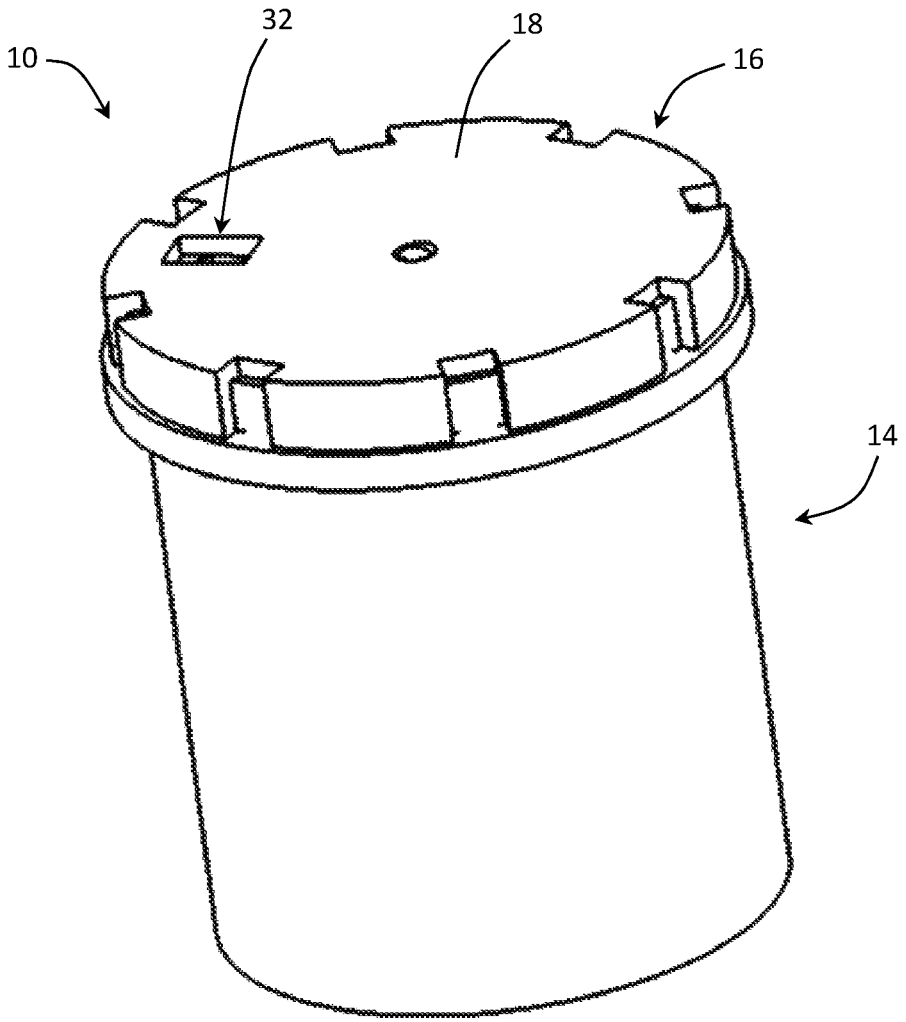
FIG. 1 is a perspective view of one embodiment of a system in accordance with the present invention.
Figure 2:
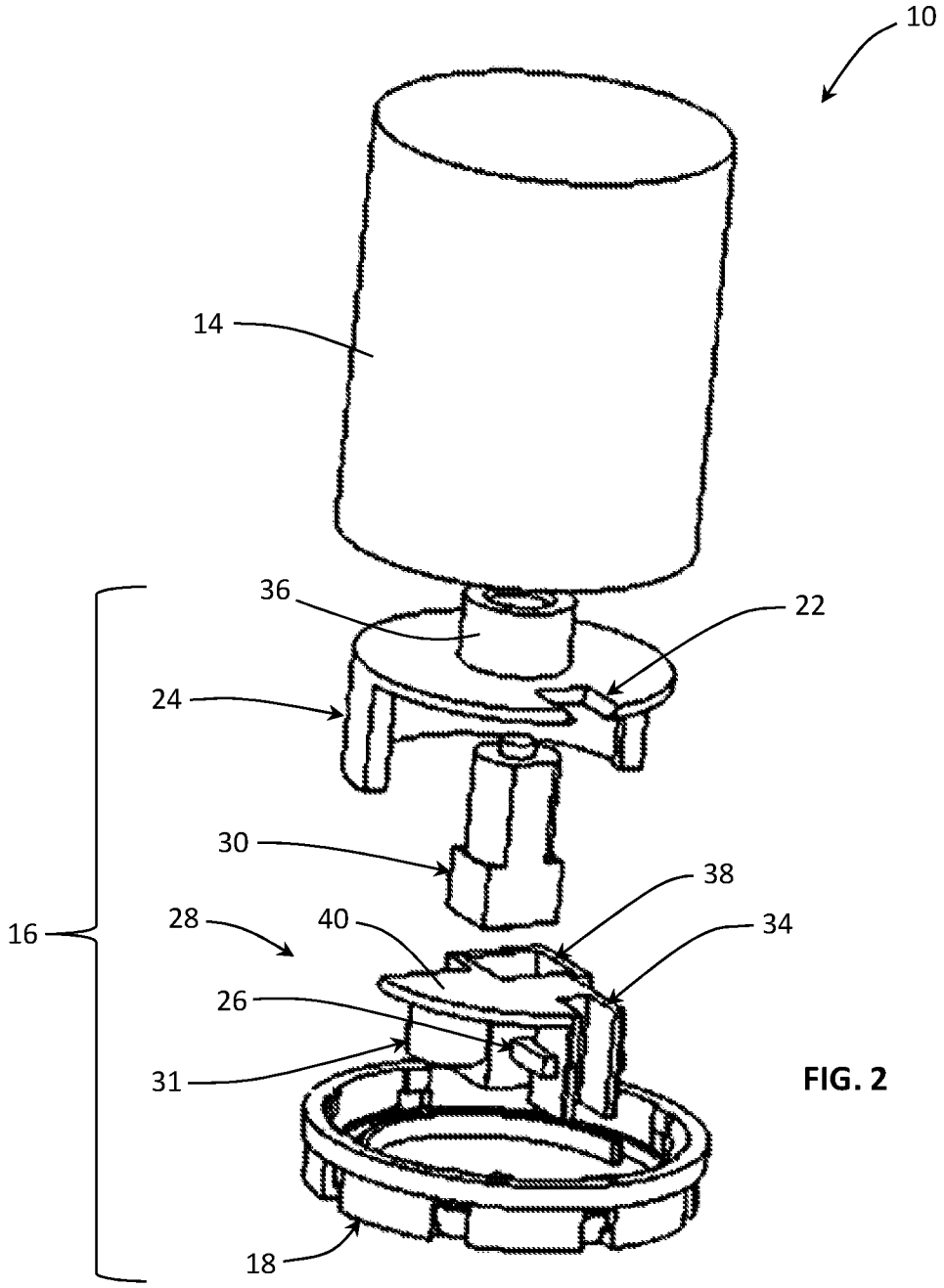
FIG. 2 is an exploded perspective view of the system of FIG. 1.
Figure 3:
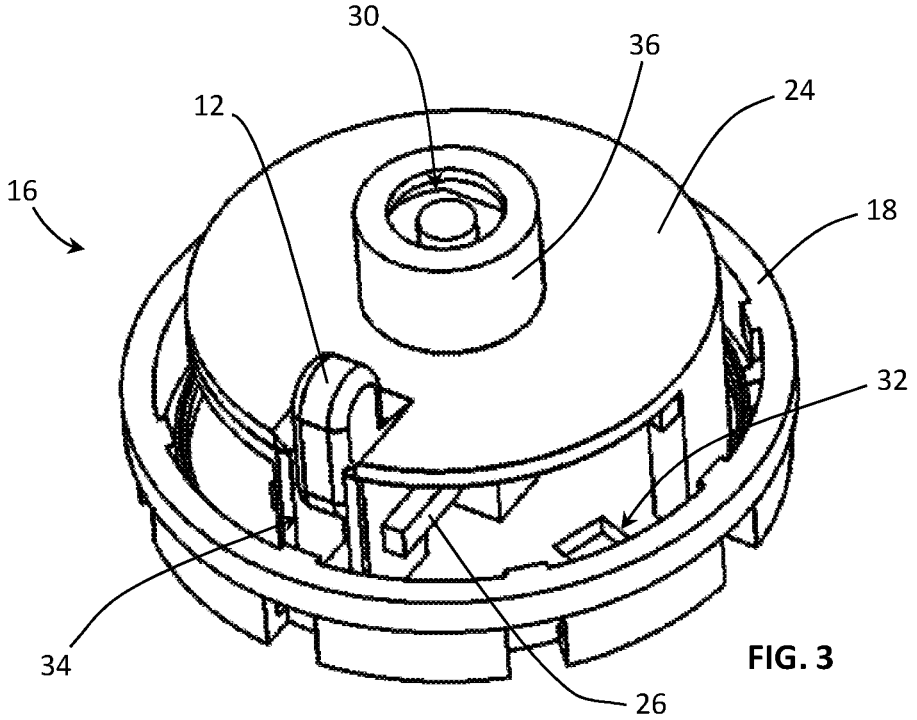
FIG. 3 is a perspective view of the cap of the system of FIG. 1 with the cap in a load position and a quantity of medication entering a chute of a transport portion of the cap.
Figure 4:
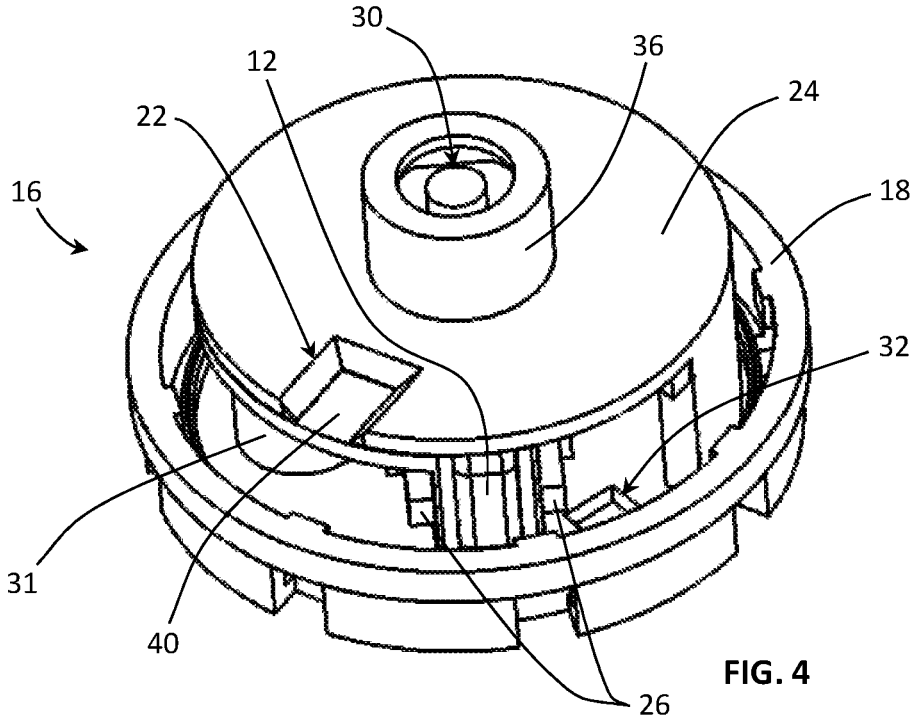
FIG. 4 is a perspective view of the cap of the system of FIG. 1 with the cap in an intermediate position and a quantity of medication contained within a chute of a transport portion of the cap.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIGS. 1-9, in selected embodiments, a system 10 in accordance with the present invention may allow a physician to prescribe a medication 12 with less concern or risk that misuse of the medication 12 will go undetected. A medication 12 may be any substance that has a reported benefit when incorporated into or onto the body of a patient by any one or more routes such as oral, rectal, intravenous, transdermal, intranasal, etc. Medication 12 may be provided in various forms including as a pill, tablet, dissolvable film, capsule, or the like.

In general, controlled or prescription medication 12 may be medication 12 whose manufacture, distribution, possession, or use is regulated by a government entity. Such medication 12 may also, in some instances, include those that have abuse or misuse potential and/or those for which control over distribution to a patient is desired by a prescriber.

Misuse is use of a medication 12 for something for which it was not intended. A non-limiting example may be use contrary to instructions provided by a medical professional (e.g., contrary to a prescription corresponding to the medication). Another non-limiting example may be using a medication 12 for a headache when the medication 12 was prescribed for pain relief (e.g., pain related to a broken arm, removal of wisdom teeth, etc.). Still another non-limiting example may be taking multiple doses of an opioid pain medication 12 without waiting the proper time period between the doses, taking a dose at the wrong time, forgetting to take a dose, and unilaterally deciding to stop taking a medication 12.

Abuse may include a patterned use of one or more medications 12 in which the user consumes the substance in amounts and/or with methods which are harmful physically, socially, psychologically, or the like to himself or herself or others. Abuse may be a form of substance-related disorder. Abuse may include use of a substance to obtain a euphoric effect and/or to avoid withdrawal symptoms.

A system 10 may enable a pharmacy to quickly and easily dispense a medication 12 without granting the patient access to all the medication 12 at one time. The patient may be limited in using the medication 12 to the frequency and dosage set by a physician (e.g., the frequency and dosage set forth in a prescription). A system 10 may be abuse deterrent and tamper proof and provide a way for the prescribing institutions to know if the medication 12 was dispensed as prescribed.

A system 10 in accordance with the present invention may selectively dispense medication 12. In some instances, a system 10 may dispense from a standard and/or specially designed medication bottle 14. A system 10 may be small, convenient, inexpensive, lockable from the pharmacy, misuse deterrent, and straightforward. A system 10 may reduce the overall costs associated with prescription medication abuse and misuse, reduce the number of overdoses, and save lives.

A system 10 may not require complex machinery. In certain embodiments, a system 10 may comprise a cap 16 that fits onto and securely engages a container 14. A container 14 may be a pill bottle, a pill box, or some other container capable of containing medication 12. In general, a container 14 may have a volume in a range from about 30 milliliters to about 175 milliliters. However, containers 14 of a lesser or greater volume may be used in certain embodiments.

In selected embodiments, a container 14 may be a standard pill bottle of a standard size that is routinely dispensed at a pharmacy (e.g., a standard plastic prescription vial or bottle). In certain embodiments, a cap 16 may not increase or may not significantly increase the size of such a container 14. That is, a cover or exterior portion 18 of a cap 16 in accordance with the present invention may have exterior dimensions that are comparable to those of a standard cap for such a container 14. In selected embodiments, this may be accomplished by positioning the various mechanisms of a cap 16 on an underside thereof so that they are positioned within the container 14 when the cap 16 is applied thereto. Accordingly, a system 10 may be compact and readily portable.

A cap 16 may engage a container 14 in a manner that prevents any unauthorized person from removing the cap 16 from the container 14. For example, in selected embodiments, an outer cover 18 of a cap 16 may include a plurality of lugs 20 that mechanically engage and/or securely lock with a container 14. In certain embodiments, the engagement between a cap 16 and a corresponding container 14 may be such that a special tool may be required to separate the two. Accordingly, by controlling access to that special tool, removal of a cap 16 from a container 14 may be controlled.

Alternatively, an engagement between a cap 16 and a corresponding container 14 may be such that destruction of the container 14 is required to separate the two. For example, once a medication 12 has been placed within a container 14 and a cap 16 has been applied, it may be mechanically impossible to separate the two without irreparably damaging one or the other. In selected embodiments, a container 14 may be the less expensive of the two. Accordingly, when a refill of a medication 12 is needed, a pharmacy may destroy the container 14 in order to free the cap 16. The cap 16 may then be applied to another container 14 into which an appropriate quantity of the medication 12 (e.g., a prescription refill) has been placed.

In certain embodiments, a cap 16 in accordance with the present invention may contain a controller (e.g., a control system) programmed or otherwise constructed to control when medication 12 is permitted to pass through the cap 16. Accordingly, a controller may be a gate keeper that controls the flow or movement of medication 12 from inside a system 10, through a cap 16, to a location outside of the system 10 where the medication 12 is accessible to a patient.

A controller may be programmed or otherwise constructed to permit a predefined amount of medication 12 to pass through a cap 16 on a predefined schedule. The predefined amount and the predefined schedule may be selected, defined, redefined, programmed in, set, updated, or the like exclusively by a medical professional who prescribes the medication, a medical professional who fills the prescription, or some other authorized person having the special tools, access codes, communication devices, or the like that are required to do the job. Thus, the amount of medication 12 that is dispensed and the timing of that dispensing may be within the control of authorized persons and outside the control of unauthorized persons (e.g., the patient).

The predefined amount of medication 12 may be the number of pills prescribed as a single dose. Accordingly, the predefined amount of medication 12 may be 1, 2, 3, 4, 5, or 6 pills or greater. In selected embodiments, the predefined amount of medication 12, the predefined schedule, or both may be adjusted automatically and/or on the fly by a controller acting autonomously or as instructed by a supervising computer. In certain embodiments, the predefined amount of medication 12 may vary by the time of day, by the number of times the system 10 dispenses medication 12, with the passage of time (e.g., decreasing with the passage of time), or the like. By controlling how much and when medication 12 is dispensed, a system 10 may prevent and/or reveal an impulsive overdose, an attempt to sell the medication 12 in large quantities, or other unwanted behavior.

In selected embodiments, an entrance gate 22 or aperture 22 of a cap 16 may be changed to accommodate a range of medications 12. That is, an entrance gate 22 suitable for admitting one pill corresponding to a first medication 12 may be too big or too small to admit one pill corresponding to a second medication 12. Thus, by swapping intake gates 22 (or an inner cover 24 having an entrance gate 22 or aperture 22 formed therein), a cap 16 may be quickly and inexpensively adapted to handle medications 12 of various types.

Alternatively, different caps 16 may be used for different medications 12. Accordingly, in situations where changing an entrance gate 22 or inner cover 24 may be insufficient to accommodate a particular medication 12, a different cap 16 that is better sized to accommodate the particular medication 12 may be selected. Thus, by properly selecting from among a variety of entrance gates 22, inner covers 24, and/or a variety of caps 16, a system 10 suitable for most if not all prescription medications 14 may be obtained.

In certain embodiments, one or more sensors 26 (e.g., electronic sensors such as optical sensors, limit sensors or switches, accelerometers, or the like) forming part of a cap 16 may detect when and how much medication 12 is dispensed, whether a system 10 has dispensed medication 12, whether an attempt (e.g., an improper attempt) has been made to access the medication 12, whether a cap 16 has been damaged, whether a container 14 has been damaged, whether a transport portion 28 of a cap 16 has reached an end to its range of motion, or the like. Data or other signals or outputs from such components 26 may be used by a controller in determining how to act (e.g., when and/or how much medication 12 to dispense). Alternatively, or in addition thereto, data or other signals or outputs from such components 26 may be communicated to other devices (e.g., remote computing devices).

For example, data output by or corresponding to such sensors 26 may be passed (e.g., via wireless communication) to a computing device (e.g., a tablet or smart phone of a patient or medical professional) that is connected to the Internet. This may make such data available for inspection by medical professionals, computer programs programmed to detect improper behavior with respect to prescription medication 12, or the like. Accordingly, various kinds of improper behavior (e.g., discrepancies between the number of pills available and numbers reported by a system 10) may be detected and used to curb abuse, limit misuse, and get those that are having difficulties the help that they need.

In selected embodiments, a cap 16 may include an outer cover 18, an inner cover 24, one or more sensors 26 or switches 26, a transport portion 28, a control system comprising or controlling the operation of an actuator 30, one or more batteries 31 providing electrical power to a control system, or the like or a combination or sub-combination thereof. An outer cover 18 may combine with a container 14 to define the exterior of a system 10 in accordance with the present invention. An outer cover 18 may include the structures necessary to mechanically engage and/or securely lock with a container 14. An outer cover 18 may have an exit aperture 32 through which dispensed medication 12 may exit a system 10.

An inner cover 24 may connect to an underside of an outer cover 18. A space between an inner cover 24 and an outer cover 18 may be occupied by a transport portion 28 and one or more components (e.g., one or more sensors 26 or switches 26, an actuator 30, a controller, or a combination or sub-combination thereof) that are connected to and move (e.g., rotate) with the transport portion 28.

An entrance gate 22 or aperture 22 in an inner cover 24 may be axially misaligned with an exit aperture 32 in an outer cover 18. In operation, a transport portion 28 may selectively move between a first location (e.g., a load position) corresponding to an alignment with an entrance aperture 22 and a second location (e.g., an unload position) corresponding to an alignment with an exit aperture 32. Thus, a transport portion 28 may transport medication 12 from an entrance aperture 22 to an exit aperture 32.

For example, in selected embodiments, a transport portion 28 may have or define a chute 34 shaped and sized to receive medication 12 (e.g., one or more pills, tablets, capsules, or the like). When the transport portion 28 is in the first location, the chute 34 may be axially aligned with an entrance gate 22 or aperture 22. Accordingly, medication 12 contained within a system 10 (e.g., within a container 14) may move (e.g., fall) through the entrance gate 22 and into the chute 34. The transport portion 28 may then be moved (e.g., rotated) to the second location. In the second location, the chute 34 may be axially aligned with an exit aperture 32. Accordingly, medication 12 may move (e.g., fall) out of the chute 34 through the exit aperture 32. In this manner, medication 12 may pass from a location within a system 10 to a location outside of a system 10.

In selected embodiments, a control system comprising an actuator 30 may control movement of a transport portion 28. In certain embodiments, an actuator 30 may comprise an electrical motor, servomotor, stepper motor, linear actuator, or the like. An actuator 30 may induce relative rotation between a transport portion 28 and the outer and inner covers 18, 24, which two covers 18, 24 may be fixed with respect to one another.

As shown in the illustrated embodiment, an inner cover 24 may include a first actuator mount 36 configured to engage a first portion of an actuator 30, while a transport portion 28 may include a second actuator mount 38 configured to engage a second portion of the actuator 30. Accordingly, when an actuator 30 effects movement (e.g., rotation)

between the first and second portions thereof, the actuator 30 may produce relative movement (e.g., rotation) between a transport portion 28 and an inner cover 24.

In selected embodiments, a transport portion 28 may include a blocking flange 40. A blocking flange 40 may block medication 12 from exiting a container 14 via an entrance aperture 22 whenever a chute 34 is not aligned with the entrance aperture 22. For example, a transport portion 28 may be configured so that when a chute 34 rotates out of alignment with an entrance aperture 22, a blocking flange 40, or some portion thereof, may rotate into alignment with the entrance aperture 22.

In certain embodiments, an actuator 30 and/or other components of a cap 16 in accordance with the present invention may require electrical power to operate. Accordingly, a cap 16 may include one or more batteries 31. For example, one or more batteries 31 may be mounted to and move with a transport portion 28.

A controller may be mounted to and move with a transport portion 28. In selected embodiments, a controller may control the flow of electricity from a battery 31 to an actuator 30 based on data or other outputs from one or more sensors 26 switches 26 or the like. For example, in certain embodiments, when medication 12 falls through an entrance gate 22 or aperture 22 and into a chute 34, one or more sensors 26 (e.g., an optical sensor) may detect the presence of the medication 12. Knowing that the chute 34 is loaded with medication 12, a controller may determine whether it would be appropriate to dispense the medication 12. If it is not the right time to dispense medication 12, the controller may do nothing. Conversely, if it is the right time to dispense medication 12, the controller may activate an actuator 30 and induce rotation of a transport portion 28.

Figure 5:
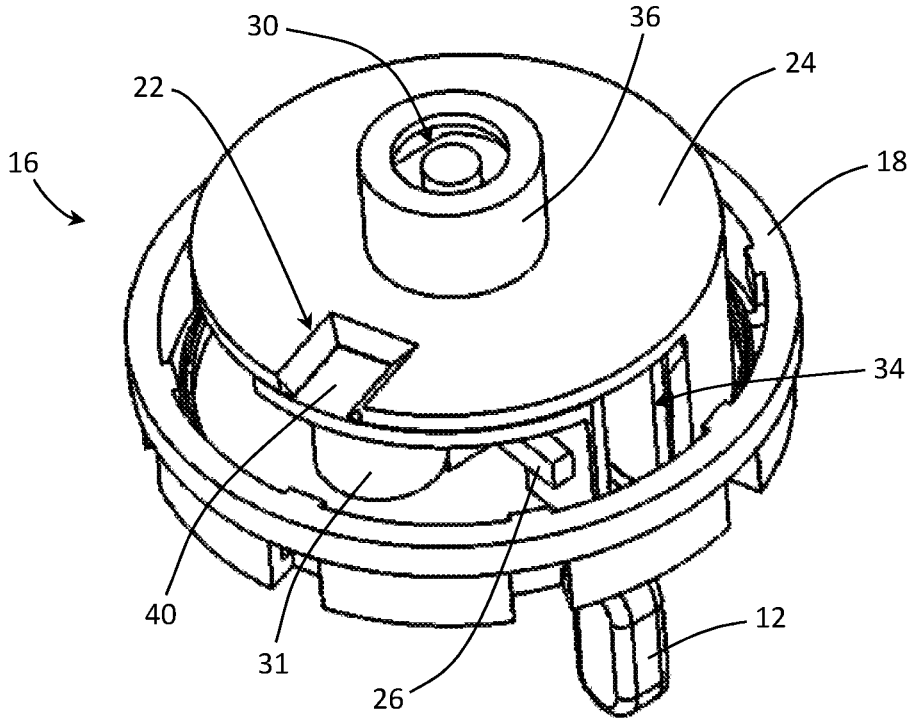
FIG. 5 is a perspective view of the cap of the system of FIG. 1 with the cap in an unload position and a quantity of medication exiting a chute of a transport portion of the cap.
Figure 6:
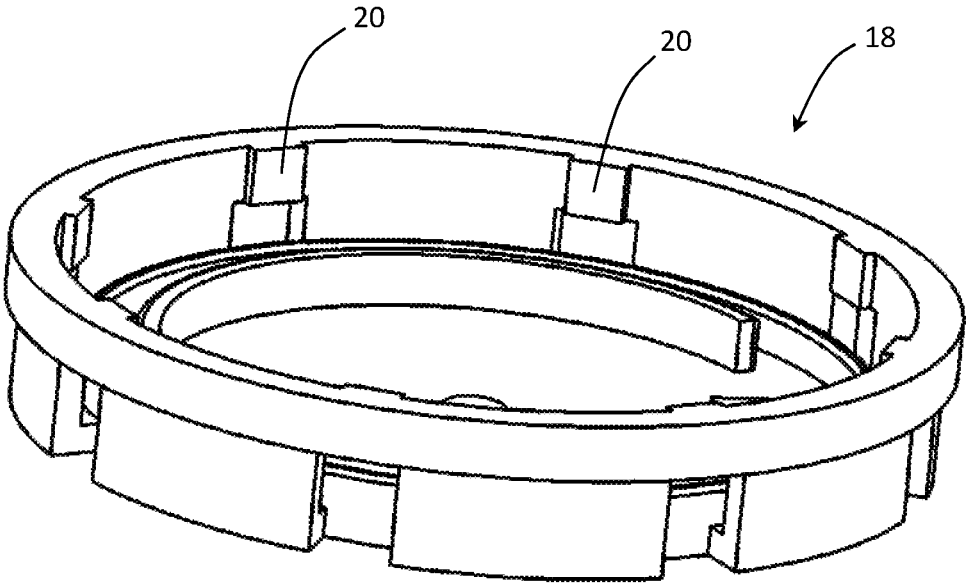
FIG. 6 is a perspective view of an outer cover of the cap of the system of FIG. 1.
Figure 7:
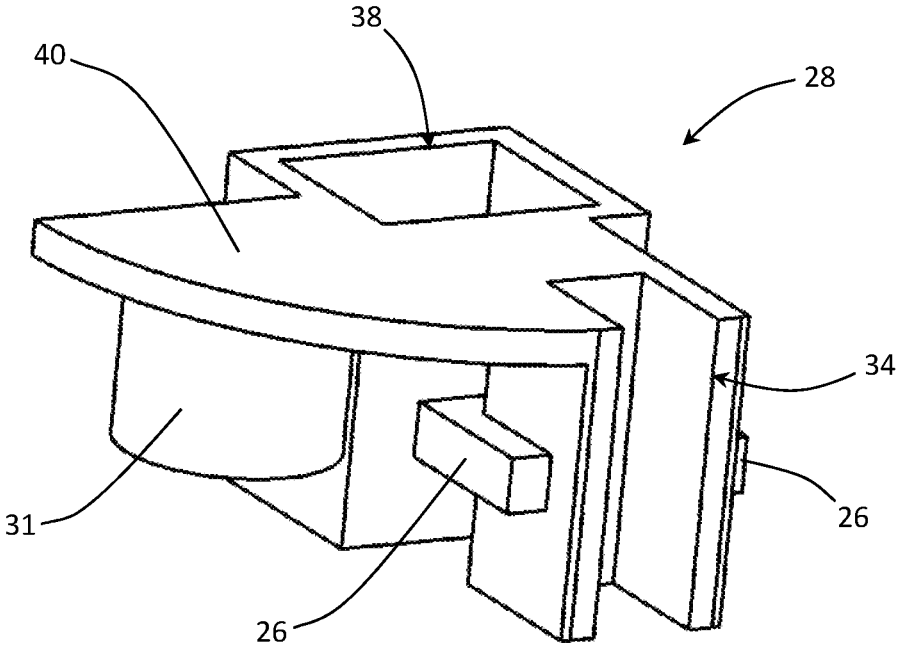
FIG. 7 is a perspective view of a transport portion of the cap of the system of FIG. 1.
Figure 8:
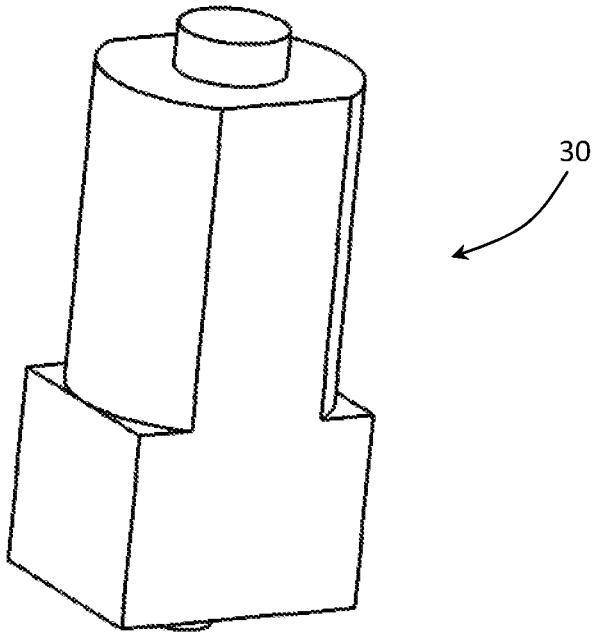
FIG. 8 is a perspective view of an actuator of the cap of the system of FIG. 1.
Figure 9:
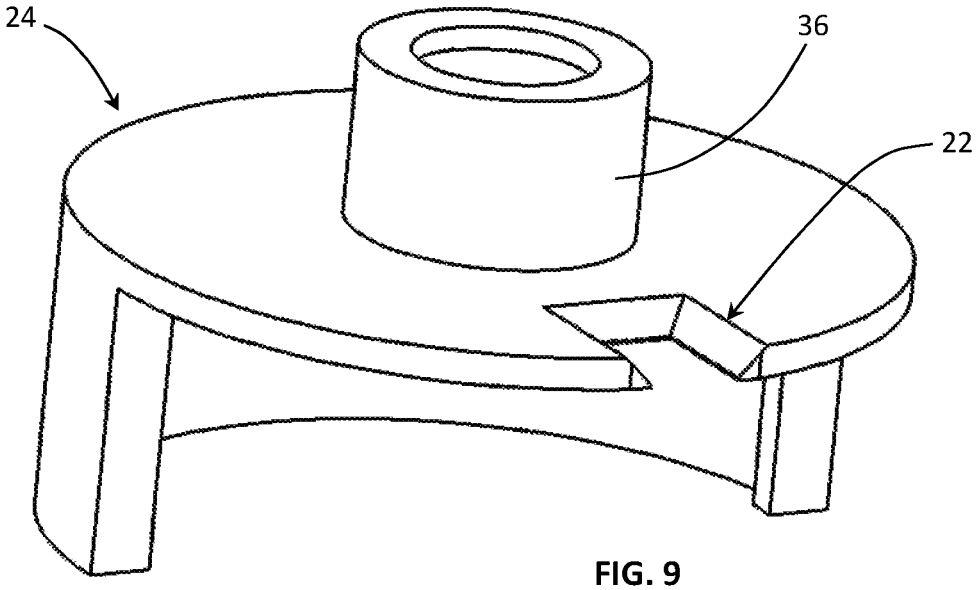
FIG. 9 is a perspective view of an inner cover of the cap of the system of FIG. 1.

In selected embodiments, this rotation may move the transport portion 28 to a second location as shown in FIG. 5. Thus, a chute 34 may move out of alignment with an entrance gate 22 and into alignment with an exit aperture 32. In the second location, the medication 12 may fall out of the chute 34 through the exit aperture 32. When medication 12 falls though an exit aperture 32, one or more sensors 26 (e.g., an optical sensor) may detect the absence of the medication 12. Knowing that the chute 34 is now empty, a controller may determine that it would be appropriate to return the transport portion 28 to the first location. In this manner, a cap 16 may be at rest and the process may be repeated until the medication 12 contained within the system 10 has all been dispensed according to (no sooner or quicker then set forth in) the predetermined schedule.

Accordingly, a system 10 may dispense a medication 12 from a pill bottle 14 or other container 14 by allowing only a limited number of dispensings in a predetermined amount of time. The system 10 may comprise a cap 16 permanently locked onto the pill bottle 14 or other container 14 using a locking mechanism releasable only by the pharmacist, and not by the patient. This may prevent the patient from accessing more medication 12 than allotted in a specific amount of time. Accordingly, the risk of a patient taking more medication 12 than prescribed, giving medication 12 to others, or selling medication 12 to others may be significantly reduced.

Alternatively, or in addition thereto, if a patient tampers with a system 10 in order to take more medication 12 than prescribed, give medication 12 to others, sell medication 12 to others, etc., that misuse may be reported by the system 10, revealed by the condition of the system 10 when it is returned to a pharmacy (which return may be required to obtain a refill), or the like. Thus, misuse of a medication 12 may be prevented or revealed as early as possible so that it may be addressed appropriately.

A cap 16 may comprise an electronic and mechanical coupling device. The electronic portion may be able to detect and determine when a medication 12 has been dispensed. If the appropriate amount of time has not elapsed, a cap 16 may not let a transport portion 28 rotate and dispense a medication 12.

A transport portion 28 of a cap 16 may be controlled electronically and automatically using a controller, battery 31, actuator 30, and/or the like or it may be manually rotated by the user depending on the design of the particular model. Thus, in selected embodiments, the electronic portions of a cap 16 may unlock or otherwise free a transport portion 28 to rotate, but may not provide that rotation (i.e., the electronics may control the lock according to a predefined schedule and the human user may provide the rotation once the transport portion 28 has been unlocked). Accordingly, when electrical power must be conserved to provide a desired service life, a hybrid system with partial electronic and partial manual actuations may be used.

An entrance gate 22 or aperture 22 or a structure (e.g., inner cover 24) providing the same may be variable or replaceable. Accordingly, the size of an entrance gate 22 or aperture 22 may be changed as needed to accommodate many different sizes of medication 12. The height of a cap 16, inner cover 24, transport portion 28, chute 34, or the like or a combination or sub-combination thereof may also be variable to accommodate different sizes of medication 12, provide additional space for a larger battery 31 or set of batteries 31, provide additional space for a larger and/or stronger actuator 30, or the like.

The electronic portion of a system 10 may incorporate a reporting mechanism that may communicate and/or sync via WIFI, BLUETOOTH, or the like with a computing device of a patient, pharmacist, or the like so that usage data may be available to those that may need to see it. There may be both an electronic anti-tamper and a mechanical anti-tamper mechanism that can also be reported. These types of usage statistics may be used by prescribers to determine if the patient will be eligible for medication refills or if they are to be deemed too high risk for a refill of a controlled medication 12.

One challenge to controlling abuse and misuse is that it has been difficult to share and/or access prescription histories for patients. A patient may cross a state border to fill a different prescription and one physician may not have access to the other state's controlled substance database. Prior to prescribing, it is expected that a provider evaluate the prescription history. However, due to the time limits placed on providers, it frequently does not happen.

Accordingly, in selected embodiments, a plurality of systems 10 may be used in conjunction with a central, interstate website. Such a website may contain data on all prescription histories, times, dates, locations, prescription providers, or the like in order to prevent cross-border doctor shopping. Electronic prescribing through such a website may also mandate that physicians review the controlled substance use history of their patients.

The development of this central website, combined with mandated physician review, and the reportable medication use, misuse, or abuse provided by one or more systems 10 may significantly reduce the cost of medication abuse, misuse, and their related deaths.

Figure 10:
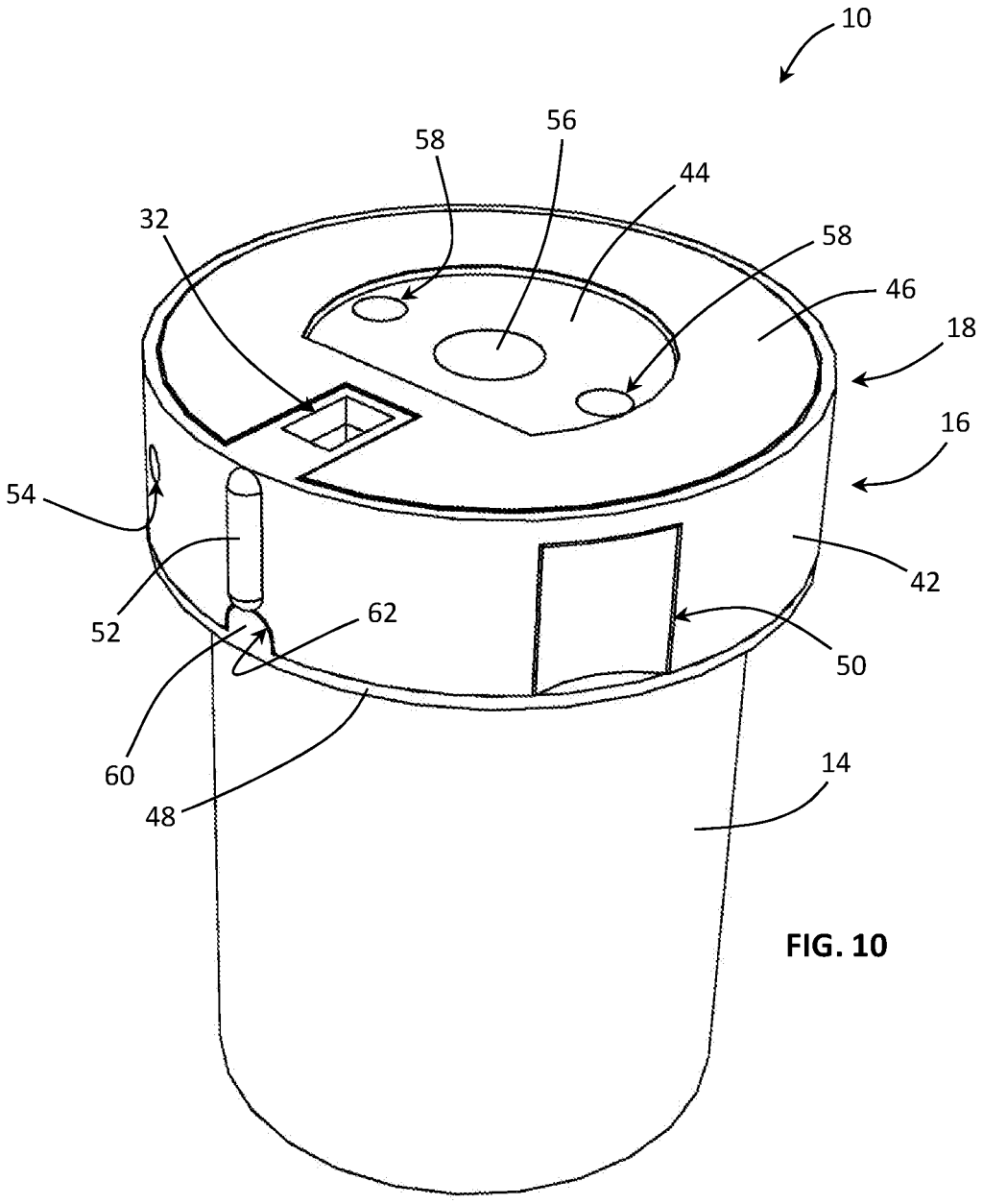
FIG. 10 is a perspective view of an alternative embodiment of a system in accordance with the present invention.
Figure 11:
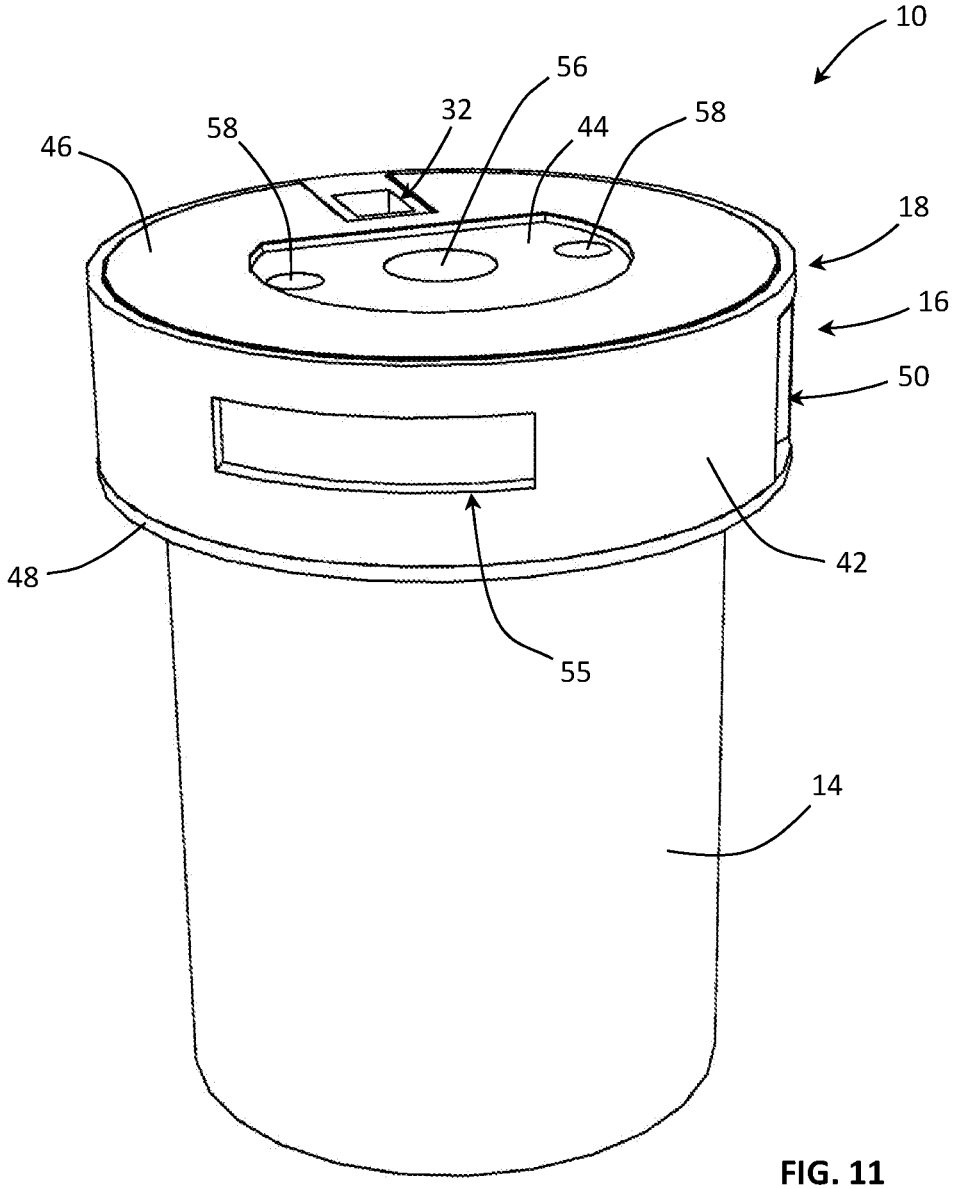
FIG. 11 is another perspective view of the system of FIG. 10.
Figure 12:
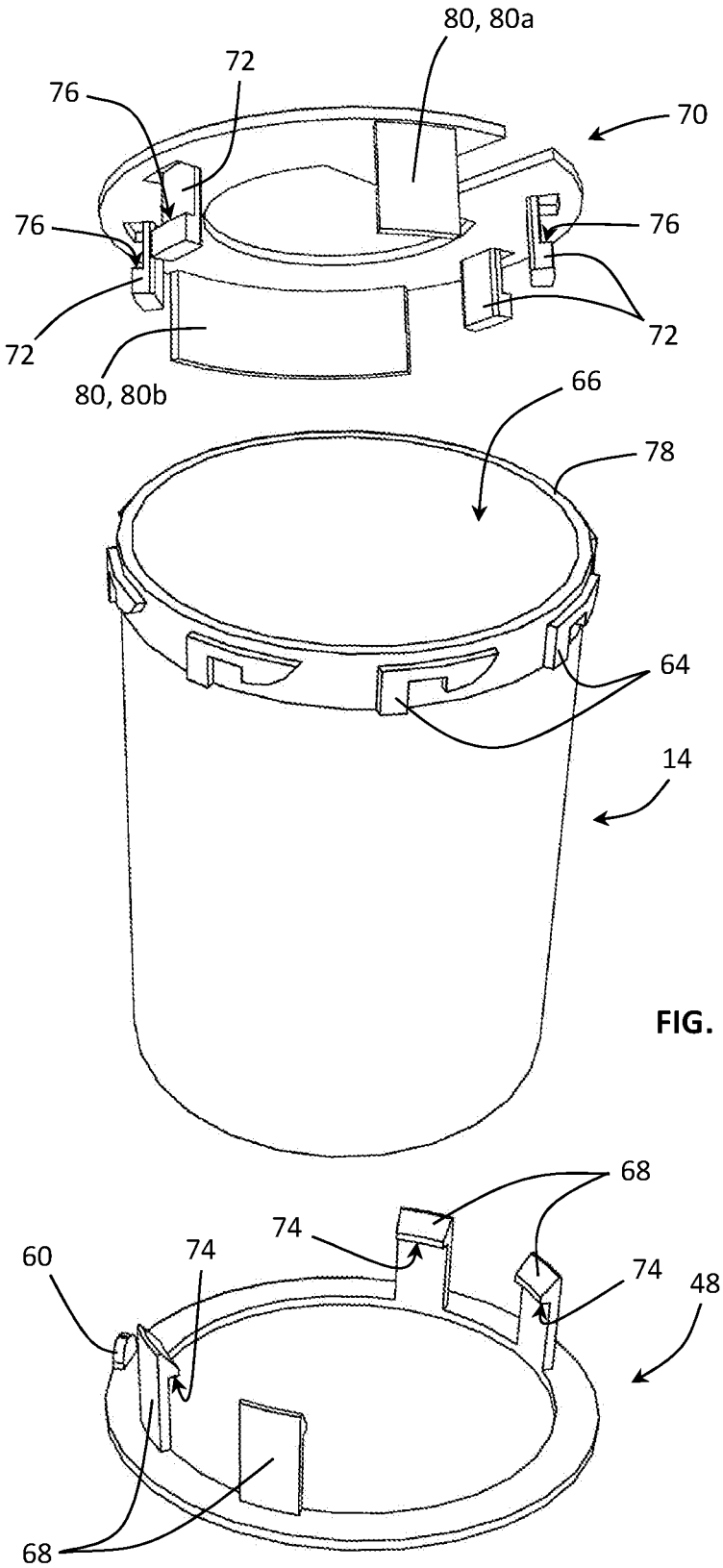
FIG. 12 is an exploded perspective view of an upper locking ring, container, and lower locking ring of the system of FIG. 10.
Figure 13:
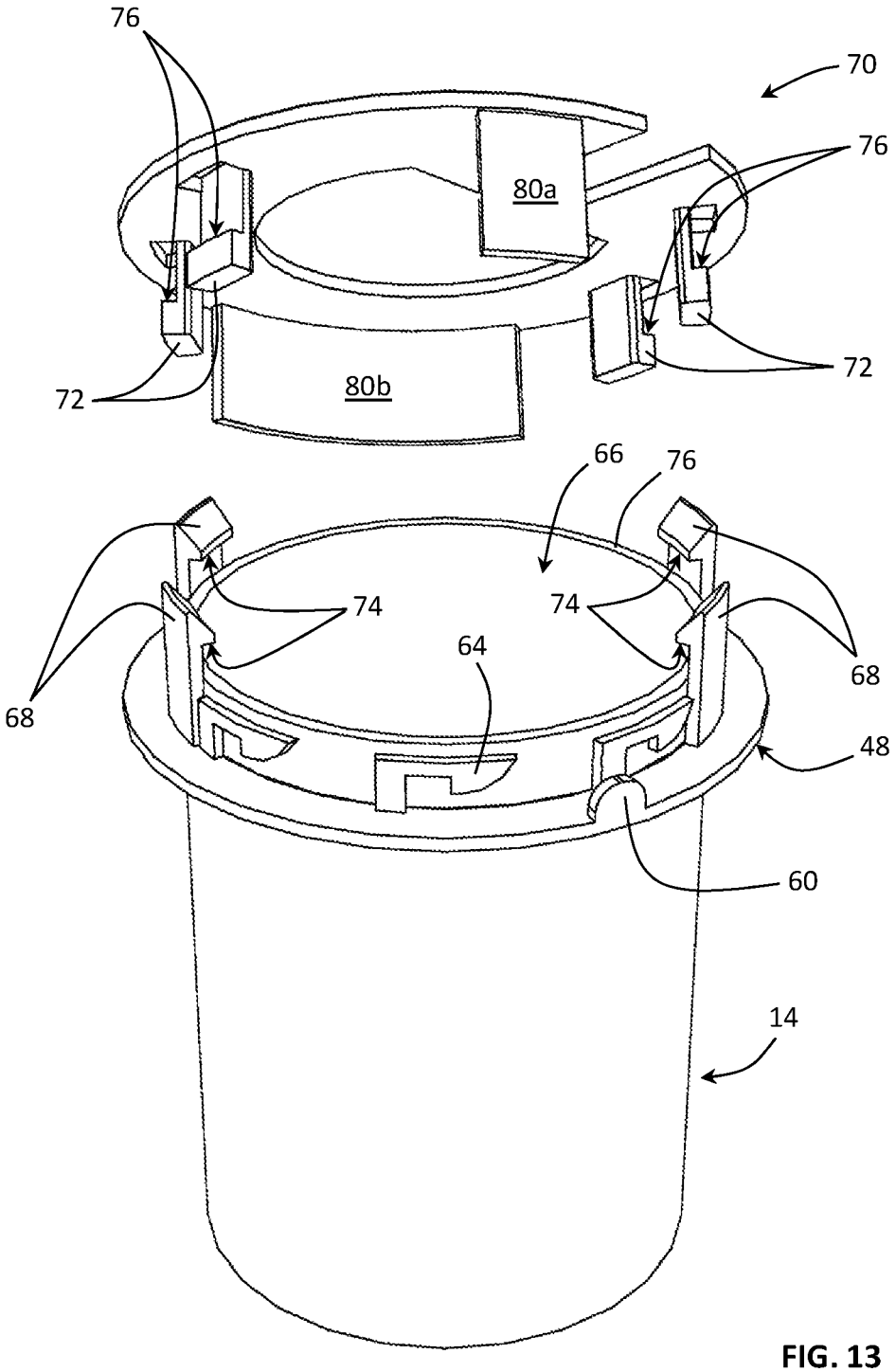
FIG. 13 is an exploded perspective view of an upper locking ring, container, and lower locking ring of the system of FIG. 10, wherein the lower locking ring is applied to the container in accordance with the present invention.
Figure 14:
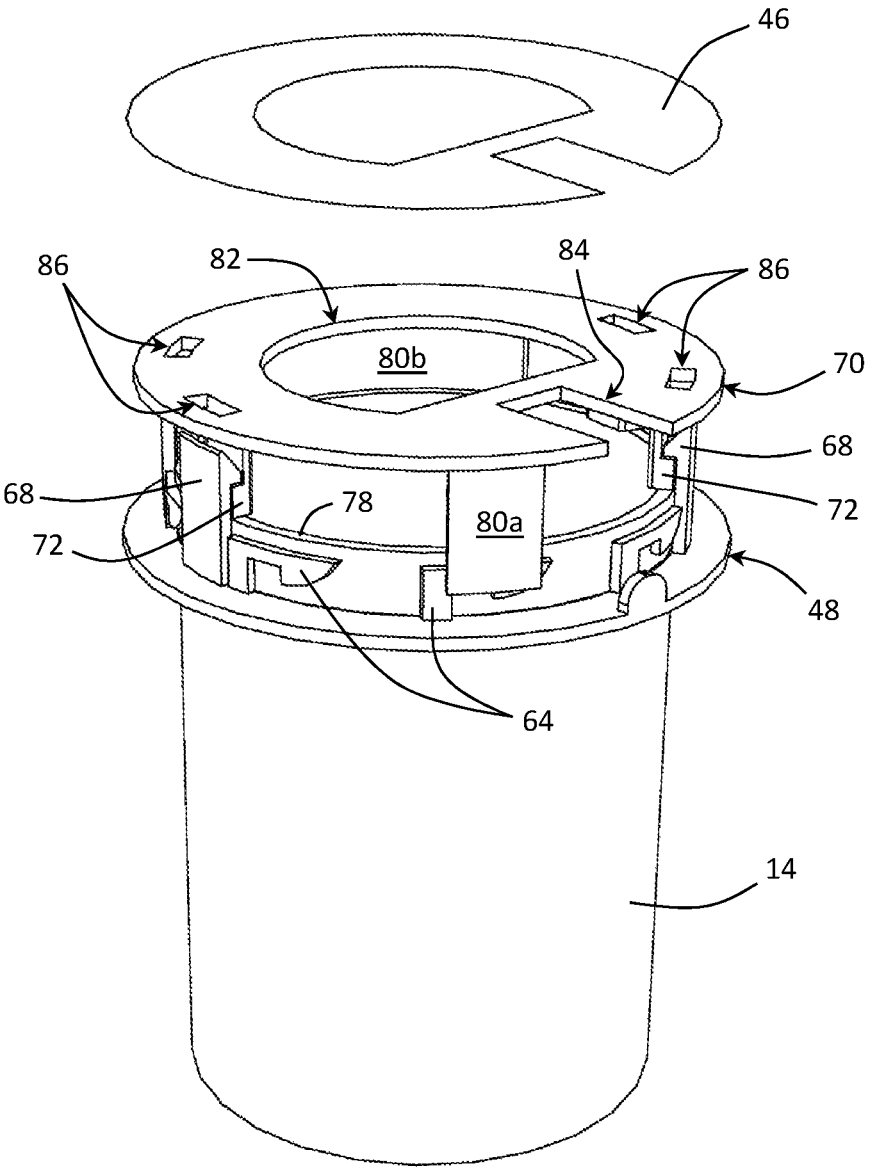
FIG. 14 is an exploded perspective view of a seal, upper locking ring, container, and lower locking ring of the system of FIG. 10, wherein the upper and lower locking rings are applied to the container in accordance with the present invention.
Figure 15:
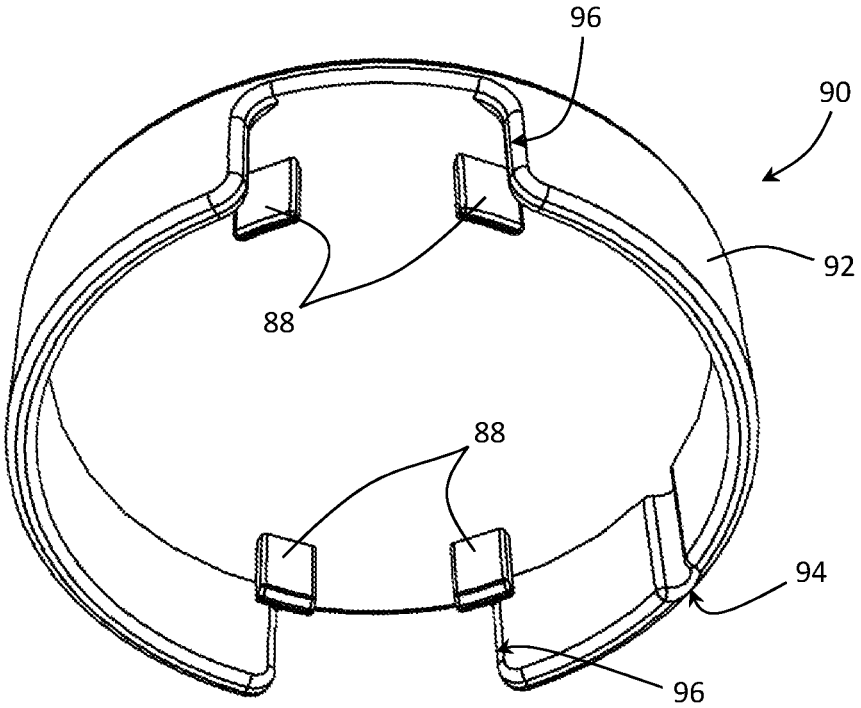
FIG. 15 is a perspective view of one embodiment of an unlocking tool configured to remove a cap of the system of FIG. 10.
Figure 16:
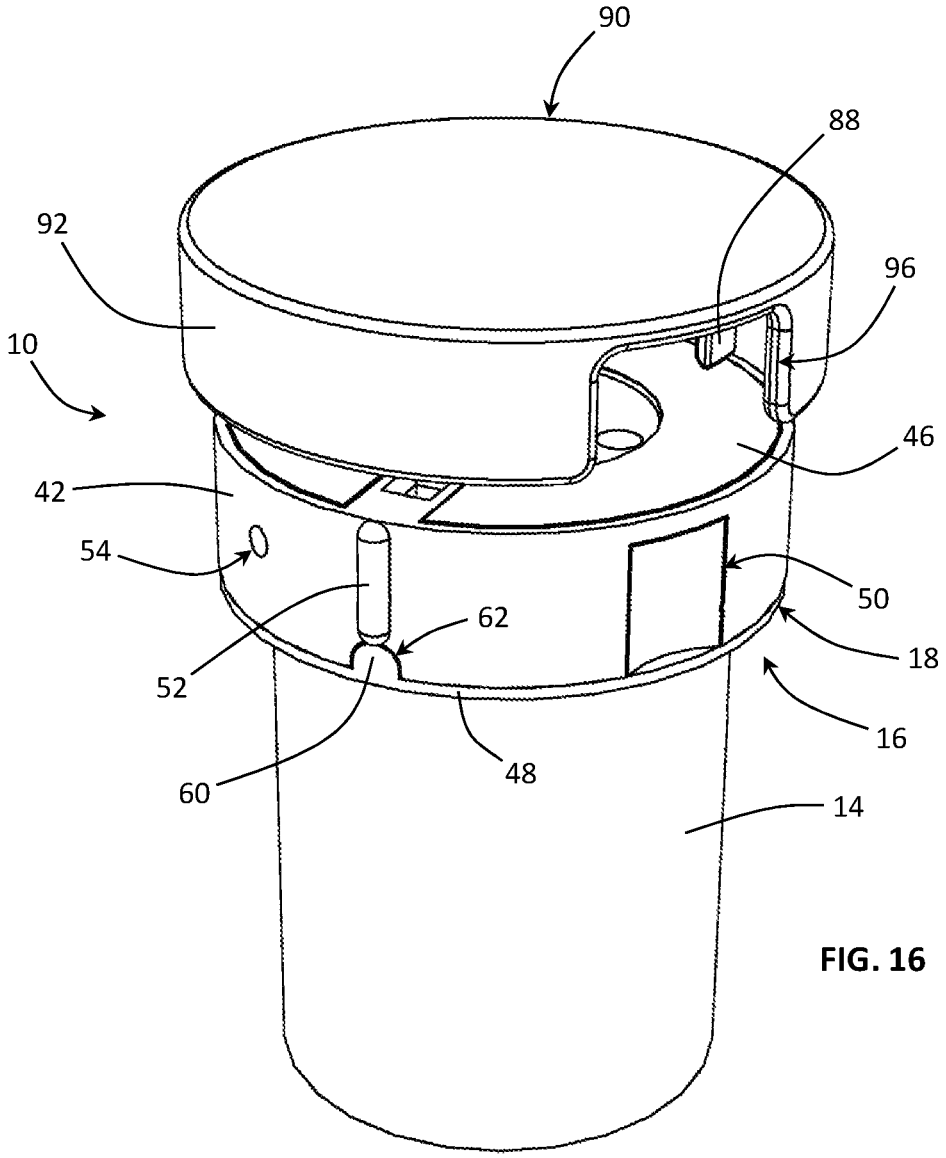
FIG. 16 is a perspective view of the unlocking tool of FIG. 15 being applied to the system of FIG. 10.
Figure 17:
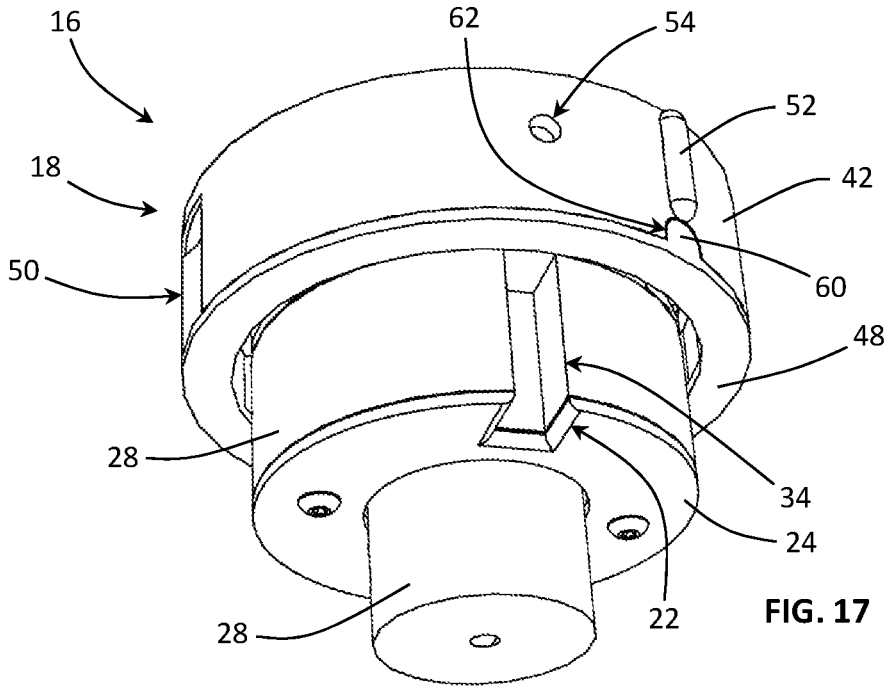
FIG. 17 is a perspective view of a cap of the system of FIG. 10.
Figure 18:
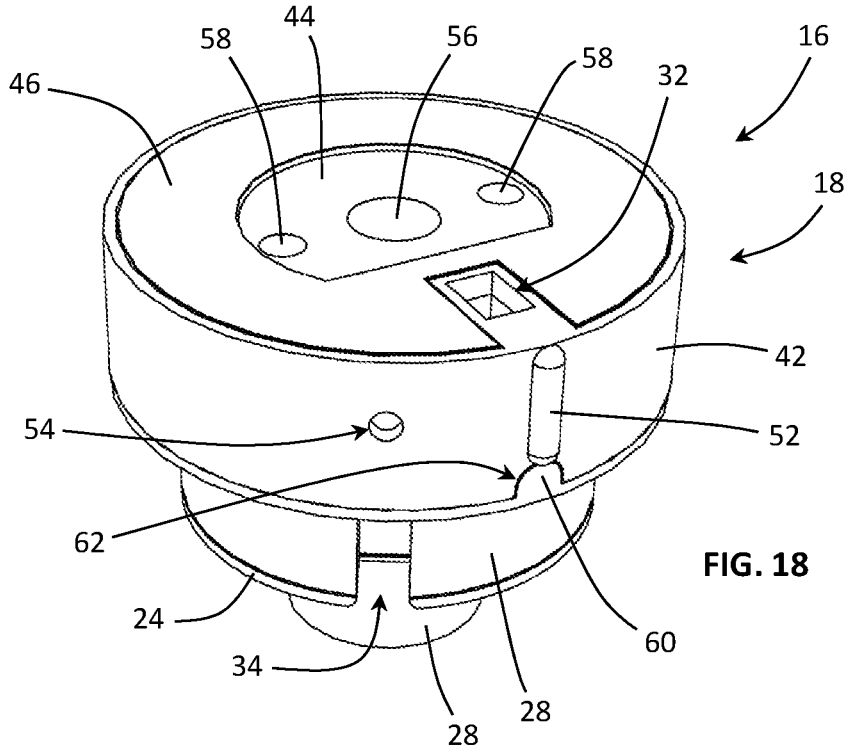
FIG. 18 is another perspective view of a cap of the system of FIG. 10.
Figure 19:
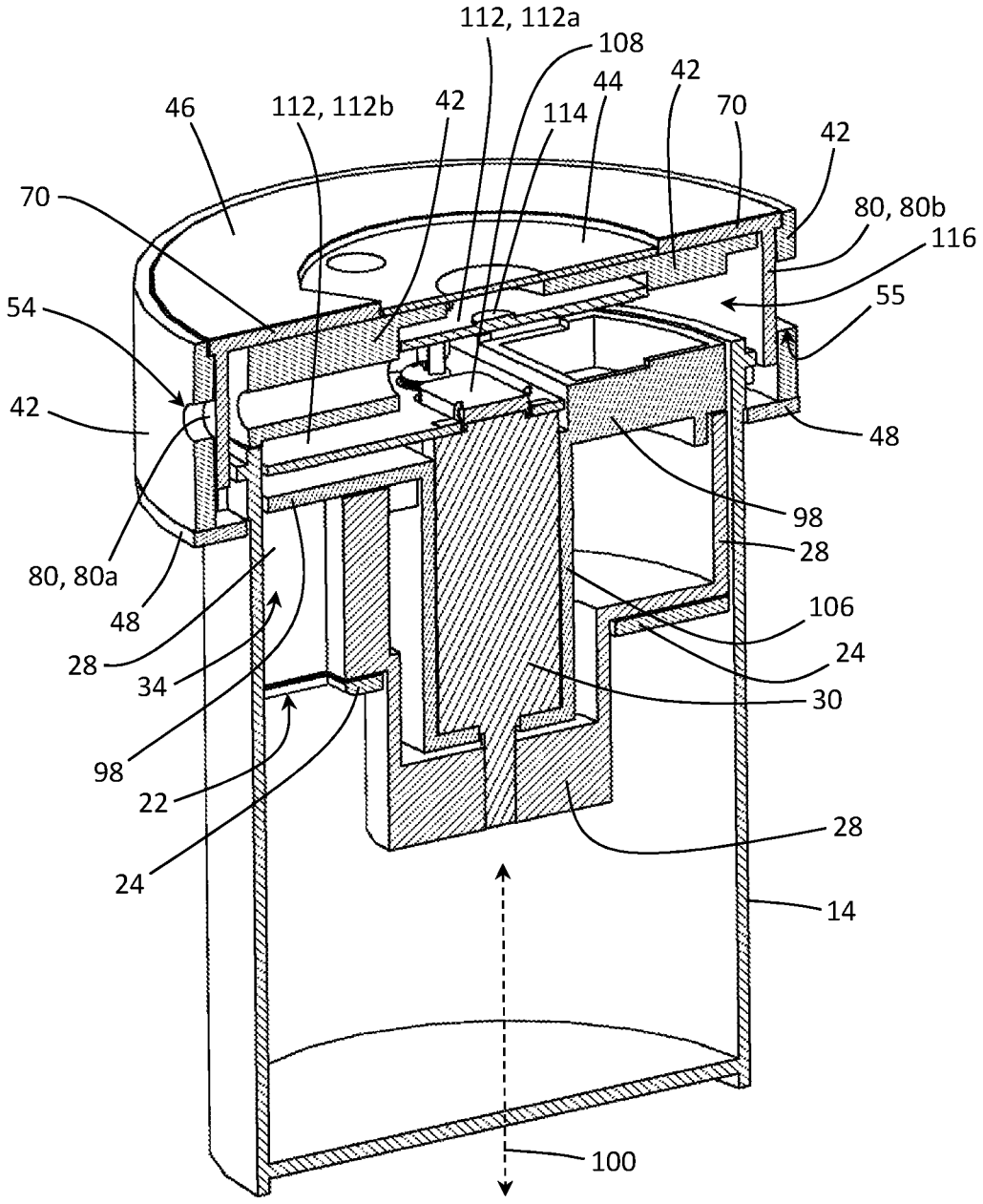
FIG. 19 is a cross-sectional perspective view of the system of FIG. 10.
Figure 20:
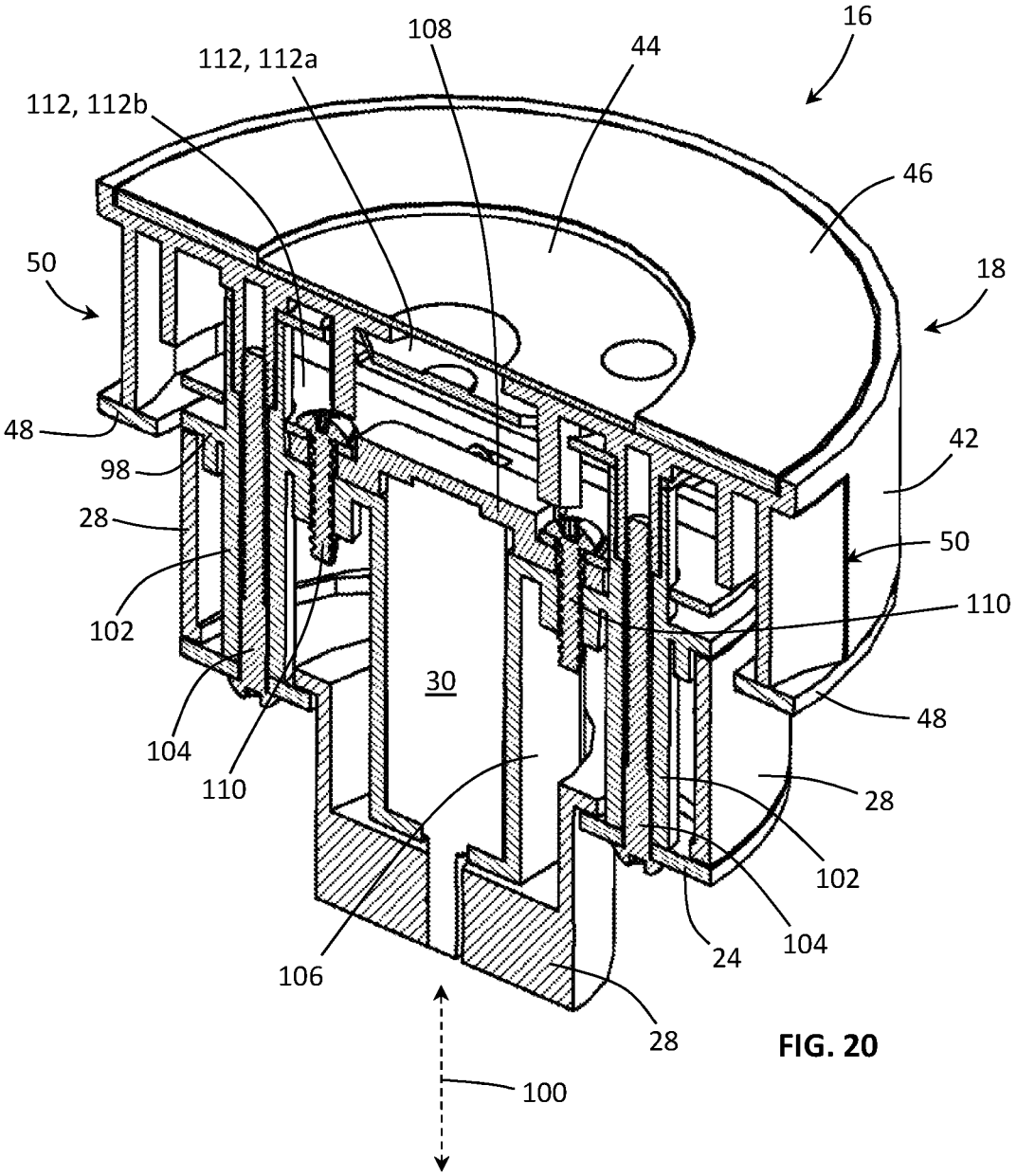
FIG. 20 is a cross-sectional perspective view of a cap of the system of FIG. 10.

Referring to FIGS. 10 and 11, in selected embodiments, an outer cover 18 of a cap 16 may include a main body 42, user interface 44, seal 46, and lower locking ring 48. A main body 42 may include or define an exit aperture 32. A main body 42 may also include one or more indentations 50 that may facilitate gripping a cap 16 during a cap-removal process. A main body 42 may also include an alignment mechanism 52. For example, a main body 42 may include an alignment mechanism 52 configured as an extension that may aid in aligning an unlocking key during a cap-removal process. A main body 42 may also include a battery-removal aperture 54. A battery-removal aperture 54 may provide a location where an elongated element or tool may be inserted in order to push a battery out an opposite side of the main body 42 (e.g., out a battery aperture 55 of a main body 42).

A user interface 44 may provide a location for a user to interact or communicate with a system 10 in accordance with the present invention. In selected embodiments, a user interface 44 may include one or more buttons 56. Alternatively, or in addition thereto, a user interface 44 may include one or more feedback devices 58. A feedback device 58 may be a light (e.g., an LED), speaker, segment display, or the like.

In certain embodiments, a user may press a button 56 to indicate that he or she would like to obtain medication 12 from the system 10. A system 10 may communicate with the user via one or more feedback devices 58. For example, if a user presses a button 56 to indicate that he or she would like to obtain medication 12 from the system 10, the system 10 may determine whether it would be appropriate (e.g., compliant with a corresponding prescription) to dispense medication 12. If it is appropriate to dispense medication 12, a feedback device 58 may so indicate (e.g., a feedback device 58 comprising a green LED may be illuminated). This may promote a user to move forward with a dispensing process (e.g., invert a system 10 and gently shake it to load a tablet or capsule of the medication 12 into a chute 34). Conversely, if it is not appropriate to dispense medication 12, a feedback device 58 may so indicate (e.g., a feedback device 58 comprising a red LED may be illuminated). Thus, in selected embodiments, a user interface 44 may include one button 56 and two feedback devices 58 (e.g., one green light and one red light) bracketing the button 56.

A user interface 44 may include a feedback device 58 in the form of a speaker. For example, if a user presses a button 56 to indicate that he or she would like to obtain medication 12 from the system 10, the system 10 may determine whether it would be appropriate to dispense medication 12. If it is appropriate to dispense medication 12, a feedback device 58 may emit a positive sound. This may promote a user to move forward with a dispensing process. Conversely, if it is not appropriate to dispense medication 12, a feedback device 58 may emit a negative sound. Thus, a user interface 44 may provide visual feedback, audio feedback, or both visual and audio feedback.

A seal 46 may prevent or reveal tampering. For example, in selected embodiments, an unlocking key may be used during a cap-removal process. A seal 46 may cover one or more apertures used by an unlocking key during such a process. Accordingly, if a seal 46 evidences that it has been penetrated, removed, or otherwise tampered with, a medical professional (e.g., a prescribing doctor, pharmacy, or the like) may be alerted that the user may be abusing the medication 12. In selected embodiments, a seal 46 may be a fragile membrane of paper, aluminum foil, plastic, or the like or a combination thereof with a strong adhesive applied to one side thereof. Accordingly, if a user attempts to remove the seal 46, the membrane may break, tear, rupture, or the like well before the strength of the adhesive can be overcome.

A lower locking ring 48 may assist in securing a cap 16 to a container 14. In selected embodiments, a lower locking ring 48 may abut against a lower surface of a main body 42. In such embodiments, a lower locking ring 48 may include an extension 60 shaped to engage (e.g., extend into) a corresponding aperture 62 in a main body 42. This may index a lower locking ring 48 and a main body 42 and ensure that they are properly aligned with respect to one another during an assembly process.

Referring to FIGS. 12-15, 26, and 27, in selected embodiments, a container 14 may be a standard polymeric prescription vial or bottle. In such embodiments, a container 14 may include various locking structures 64 shaped to receive a standard child-proof cap. In certain embodiments, these locking structures 64 may enable a cap 16 in accordance with the present invention to grip and lock onto the corresponding container 14. For example, a lower locking ring 48 may be slipped over a closed end of a container 14. The lower locking ring 48 may slide up the container 14 until it contacts an under side of the locking structures 64. The locking structures 64 may prevent a lower locking ring 48 from sliding off the open end 66 of the container 14.

Once a lower locking ring 48 is in place, one or more locking extensions 68 thereof may extend to engage a complementary component and lock a cap 16 to the container 14. For example, in selected embodiments, a cap 16 may include an upper locking ring 70. In selected embodiments, an upper locking ring 70 may include one or more locking extensions 72 that extend to engage corresponding locking extensions 68 of a lower locking ring 48. The various locking extensions 68, 72 may have respective engagement shoulders 74, 76. Thus, the engagement shoulders 74 of the locking extensions 68 of the lower locking ring 48 may engage the engagement shoulders 76 of the locking extensions 72 of the upper locking ring 70.

Additionally, the locking extensions 72 of the upper locking ring 70 may abut an upper rim 78 or lip 78 of a container 14. Thus, when a cap 16 is applied to a container 14, the various engagements of (1) the lower locking ring 48 with an underside of the locking structures 64 of the container, (2) the upper locking ring 70 with the top lip 78 or rim 78 of the container 14, and (2) the locking extensions 68 of the lower locking ring 48 with the locking extensions 72 of the upper locking ring 48 may cooperate to securely fix the cap 16 on the container 14.

In selected embodiments, an upper locking ring 70 may include one or more blocking extensions 80. For example, when a cap 16 is fully assembled, a first blocking extension **80*a* may block a battery-removal aperture 54 and a second blocking extension 80*b* may block a battery aperture 55 (e.g., an aperture 55 in a main body 42 through which a battery 31 may be inserted or removed). Thus, when a cap 16 is fully assembled, a battery 31 may not be removed in an effort to circumvent the security processes of a system 10** in accordance with the present invention.

Referring to FIGS. 14-17, in selected embodiments, an upper locking ring 70 may have various apertures 82, 84, 86 formed therein. For example, an upper locking ring 70 may include a central aperture 82 providing a space for a user interface 44. An upper locking ring 70 may also include an exit cutout 84 providing a space for the portion of a main body 42 defining an exit aperture 32. An upper locking ring 70 may also include one or more key apertures 86.

A key aperture 86 may be shaped and positioned to receive an unlocking key 88 therewithin. When an unlocking key 88 is inserted within a key aperture 86, it may disengage the engagement shoulders 74, 76 of corresponding locking extensions 68, 72 of the lower and upper locking rings 48, 70. Thus, the number and location of key apertures 86 in an upper locking ring 70 may correspond to the number and location of the engagements between locking extensions 68, 72 of the respective lower and upper locking rings 48, 70.

In certain embodiments, a seal 46 may have a shape (e.g., a perimeter) that matches or substantially matches a perimeter of a top surface 89 of an upper locking ring 70. Thus, like an upper locking ring 70, a seal 46 may have certain apertures formed therein. This may enable a seal 46 to cover one or more key apertures 86 without covering a user interface 44 or an exit aperture 32. Accordingly, since an upper locking ring 70 may provide the structure supporting a seal 46, an upper locking ring 70 may be considered to be part of an outer cover 18 of a cap 16.

In selected embodiments, an unlocking tool 90 may include one or more unlocking keys 88. The number and location of the one or more unlocking keys 88 on an unlocking tool 90 may correspond to the number and location of the key apertures 86. Accordingly, when an unlocking tool 90 is applied to a cap 16 installed on a container 14 in accordance with the present invention, the unlocking tool 90 may simultaneously release all engagements of the lower locking ring 48 with the upper locking ring 70. Thus, applying an unlocking tool 90 to a cap 16 may enable the cap 16 to be removed from the corresponding container 14.

In certain embodiments, an unlocking tool 90 may include various features that facilitate proper alignment of the tool 90 with a cap 16 that is to be removed. Such features may include a border 92 shaped to closely follow and encircle a cap 16. Additionally, a border 92 may have an indentation 94 formed therein. An indentation 94 may be sized and shaped to receive an alignment mechanism 52 of a cap 16. Accordingly, a border 92 combined with an indentation 94 may ensure that an unlocking tool 90 may only be applied to a cap 16 when the tool 90 is properly aligned with the cap 16.

In selected embodiments, an unlocking tool 90 may include one or more cutouts 96. Such cutouts 96 may be positioned to expose one or more indentations 50 formed in a cap 16 whenever the tool 90 is applied to the cap 16. Accordingly, in a cap-removal process, an unlocking tool 90 may be positioned proximate a cap 16 and aligned therewith. The unlocking tool 90 may then be advanced unto the cap 16. This advancing may cause the unlocking keys 88 to penetrate a seal 46 and advance into corresponding key apertures 86.

Once the unlocking tool 90 is fully seated onto a cap 16, a user may access one or indentations 50 in the cap 16 through corresponding cutouts 96 in the unlocking tool 90. Thereafter, pulling the cap 16 and tool 90 away from the container 14 may result in the majority of the cap 16 being removed from the container 14. That is, the lower locking ring 48 may be left behind, but most of the cap 16 may be removed. Accordingly, the medication 12 within the container 14 may be refilled. Thereafter, the cap 16 may be reassembled on the container 14 and the refilled system 10 may be reused (e.g., returned to the appropriate patient with a new seal 46 in place).

Referring to FIGS. 17-20, 30-32, 35, and 36, in selected embodiments, a cap 16 in accordance with the present invention may include an outer cover 18, an inner cover 24, an interface 98, and a control system. An outer cover 18 may include a main body 42, user interface 44, seal 46, lower locking ring 48, upper locking ring 70, or the like or combination or sub-combination thereof. An inner cover 24 may have an entrance gate 22 or aperture 22 formed therein. An interface 98 may extend to connect and rotationally fix an outer cover 18 with respect to an inner cover 24.

An interface 98 may space an outer cover 18 with respect to an inner cover 24 in an axial direction 100 to enable a transport portion 28 to rotate between the outer and inner covers 18, 24. In selected embodiments, an interface 98 may include one or more posts 102 that extend in the axial direction 100. The posts 102 may include apertures therewithin shaped and sized to receive threaded fasteners 104. On a lower end thereof, the posts 102 may contact and support an inner cover 24. On an upper end thereof, the posts 102 may contact and support a main body 42 of an outer cover 18. Accordingly, fasteners 104 extending within the posts 102 may connect an inner cover 24 and an outer cover 18 to an interface 98 (and, thereby, to each other) and maintain a space between the inner and outer covers 24, 18 for a transport portion 28 to reside and move (e.g., rotate or pivot about a central axis extending in the axial direction 100).

In certain embodiments, an interface 98 may also provide a structure to which or within which one or more components of a control system may be mounted. For example, an interface 98 may include an actuator housing 106 and an actuator mount 108. An actuator housing 106 may provide a location for an actuator 30 to reside. In selected embodiments, an actuator 30 may comprise an electrical motor and an associated gear reduction system. Accordingly, an actuator housing 106 may house the electrical motor and associated gear reduction system. An actuator mount 108 may lock or secure an actuator 30 within an actuator housing 106. In certain embodiments, fasteners 110 (e.g., threaded fasteners) may removably secure an actuator mount 108 to the rest of an interface 98.

In selected embodiments, a control system may control the operation of a system 10 in accordance with the present invention. Accordingly, a control system may determine with sufficient time has passed since a first portion of medication 12 was dispensed for it to be appropriate (e.g., compliant with a prescription corresponding to the medication 12) to dispense a second portion of the medication 12.

In certain embodiments, a control system may include one or more circuit boards 112, an actuator 30, one or more batteries 31, or the like or a combination or sub-combination thereof. For example, a control system may include an upper circuit board 112*a* and a lower circuit board 112*b*. An upper circuit board 112*a* may be configured to interact with or support the operation of a user interface 44. Accordingly, an upper circuit board 112*a* may include a switch or button 114 located below a button 56 of a user interface 44. Actuation of the button on the user interface 44 may result in actuation of the button 114 on the upper circuit board 112*a*. An upper circuit board 112*a* may also include one or more lights (e.g., one or more LEDs) or the like corresponding to (e.g., providing source light for) one or more feedback devices 58 of a user interface 44.

A lower circuit board 112*b* may be larger than an upper circuit board 112*a* and have more components of a control system mounted thereon. For example, a lower circuit board 112*b* may include and appropriately connect a processor, memory, one or more speakers, one or more sensors 26, or the like or a combination thereof. In selected embodiments, one or more fasteners 110 securing an actuator mount 108 to the rest of an interface 98 may also secure a lower circuit board 112*b* to an interface 98.

In certain embodiments, a battery 31 may be a coin battery that may be inserted through a battery aperture 55 into a space 116 between an interface 89 and a main portion 42 of an outer cover 18. So positioned, a battery 31 may provide electrical power to one or more circuit boards 112 of other components (e.g., an actuator 30) of a control system.

Figure 21:
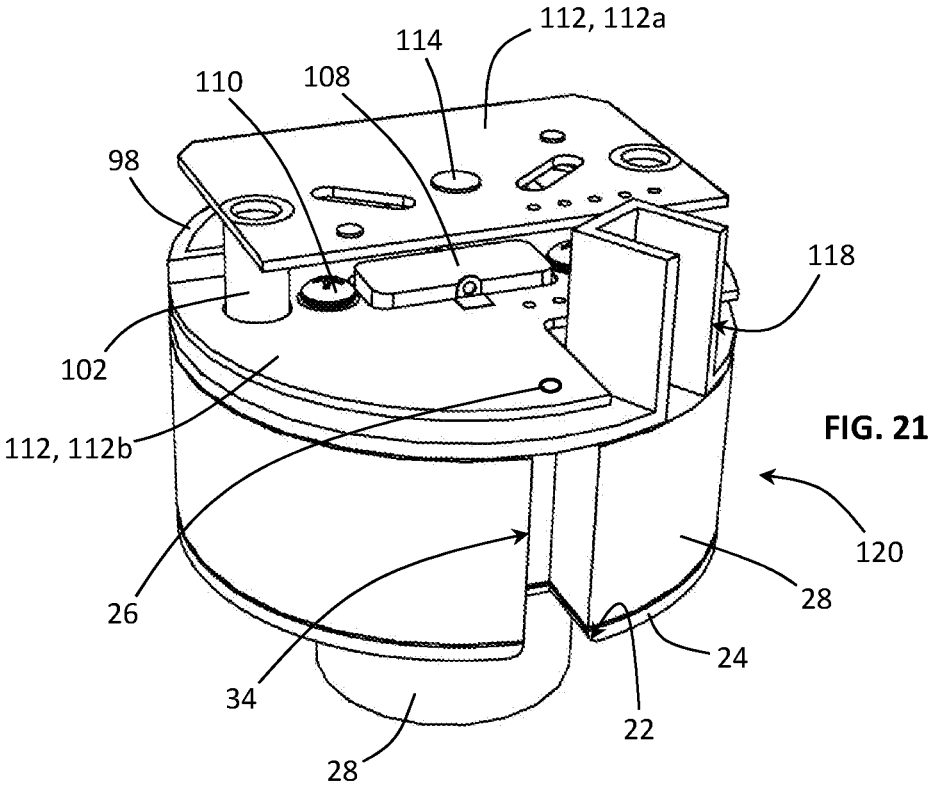
FIG. 21 is a perspective view of a partially assembled cap of the system of FIG. 10, wherein the chute of the transport portion is in a load position in accordance with the present invention.
Figure 22:
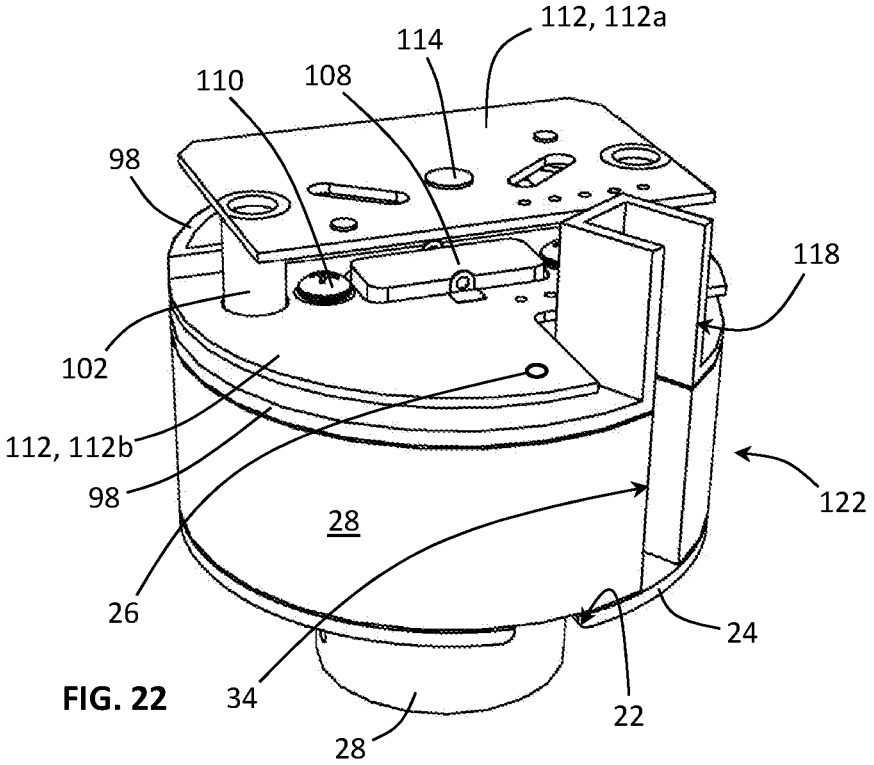
FIG. 22 is a perspective view of a partially assembled cap of the system of FIG. 10, wherein the chute of the transport portion is in an unload position in accordance with the present invention.

Referring to FIGS. 21 and 22, in selected embodiments, an interface 98 may include a channel 118 for conducting or passing medication 12. A channel 118 may have a location that is fixed with respect to, and aligned with, an exit aperture 32. Accordingly, when a chute 34 of a transport portion 28 pivots or rotates into alignment with an exit aperture 32, the chute 34 may also pivot or rotate into alignment with the channel 118 of an interface 98. This may enable medication 12 contained within the chute 34 to pass (e.g., fall when the system 10 is properly oriented for dispensing) out of the chute 34, pass through the channel 118 in the interface 98, and exit a system 10 through an exit aperture 32.

In certain embodiments, an interface 98 or selected portions thereof may be formed of a transparent or semi transparent material (e.g., a transparent or semi transparent polymeric material). This may enable one or more sensors 26 (e.g., one or more optical sensors 26) mounted on a circuit board 112*b* to see when a tablet, capsule, or the like of medication 12 is loaded within a chute 34 of a transport portion 28.

For example, in operation, a transport portion 28 may selectively move between a first location (e.g., a load position 120) corresponding to an alignment with an entrance aperture 22 and a second location (e.g., an unload position 122) corresponding to an alignment with an exit aperture 32. A sensor 26 may be positioned on a circuit board 112*b* so as to be proximate one end of the chute 34 when the transport portion 28 is in the load position 120. Accordingly, a sensor 26 may perceive through an interface 98 whether a tablet, capsule, or the like of the medication 12 is loaded within the chute 34.

Thus, in a dispensing operation, a user may press a button 56 to communicate his or her desire to receive a dose of medication 12. If it is an appropriate time to dispense a dose of the medication 12, a feedback device 58 may so indicate and a system 10 may prepare to dispense medication 12 (e.g., return a transport portion 28 to a load position 120 if it is not already in that position). Accordingly, the user may invert the system 10 and gently shake it until a tablet, capsule, or the like is loaded within a chute 34 of the transport portion 28.

When the control system detects via the sensor 26 that a tablet, capsule, or the like is loaded within the chute 34, the transport portion 28 may be moved (e.g., rotated or pivoted) to the unload position 122. In the unload position 122, the chute 34 may be axially aligned with an exit aperture 32. Accordingly, with the system 10 still inverted, medication 12 may fall out of the chute 34, pass through the channel 118, and exit the system 10 through an exit aperture 32.

Figure 23:
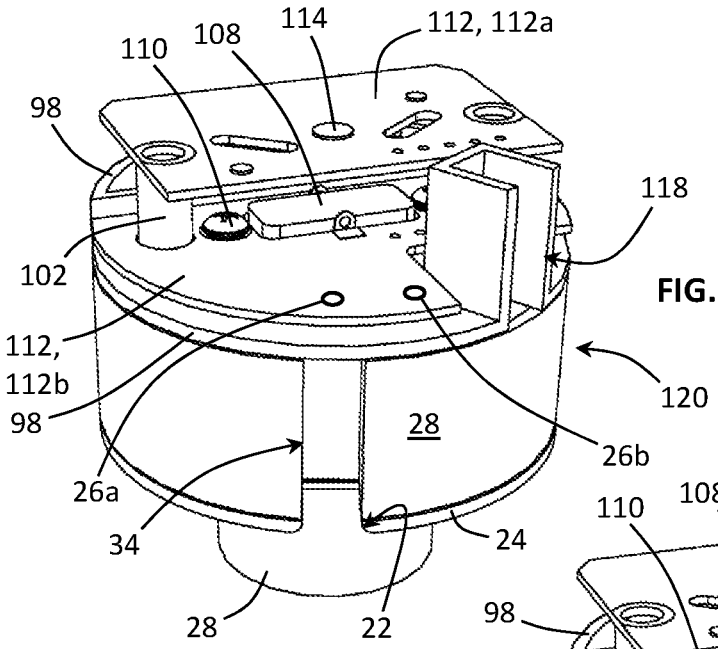
FIG. 23 is a perspective view of a partially assembled cap of an alternative embodiment of a system in accordance with the present invention, wherein the chute of the transport portion is in a load position.
Figure 24:
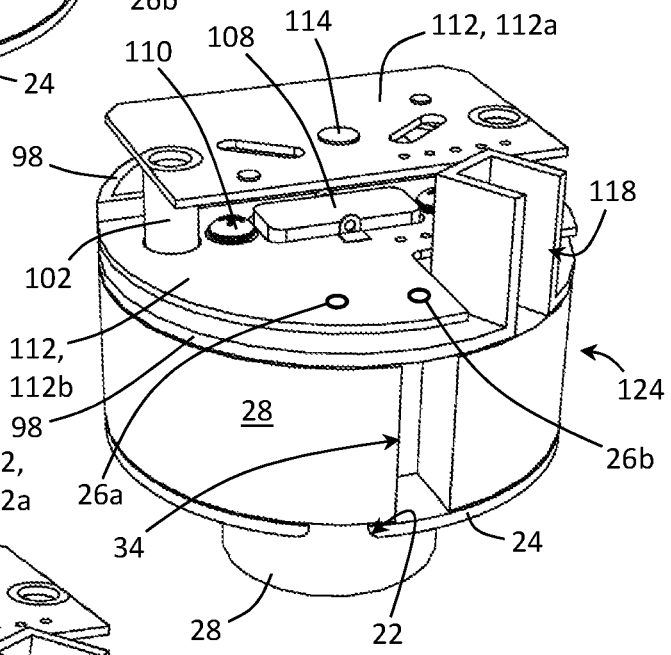
FIG. 24 is a perspective view of the partially assembled cap of FIG. 23, wherein the chute of the transport portion is in an intermediate position.
Figure 25:
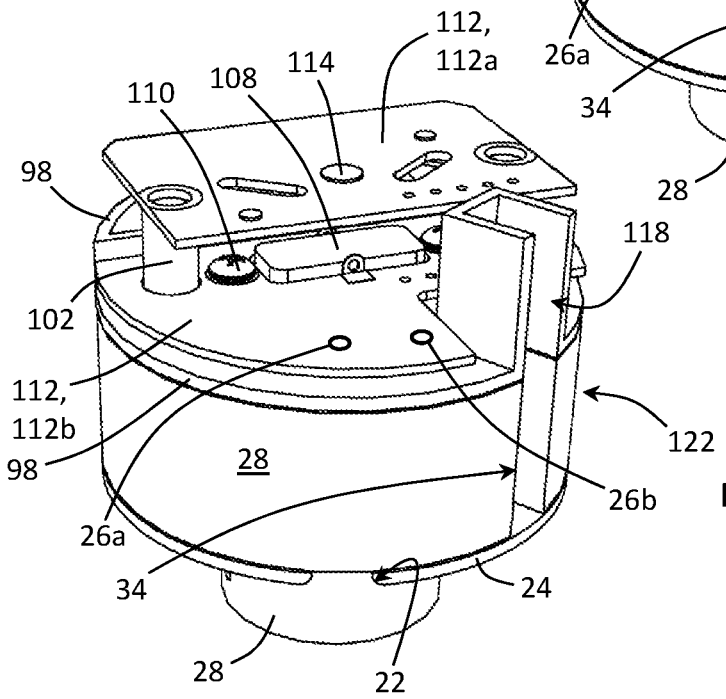
FIG. 25 is a perspective view of the partially assembled cap of FIG. 23, wherein the chute of the transport portion is in an unload position.
Figure 26:
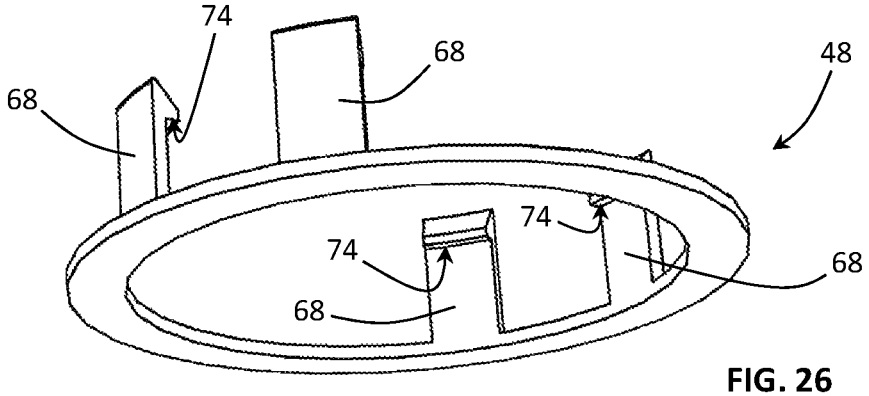
FIG. 26 is a perspective view of a lower locking ring of the system of FIG. 10.
Figure 27:
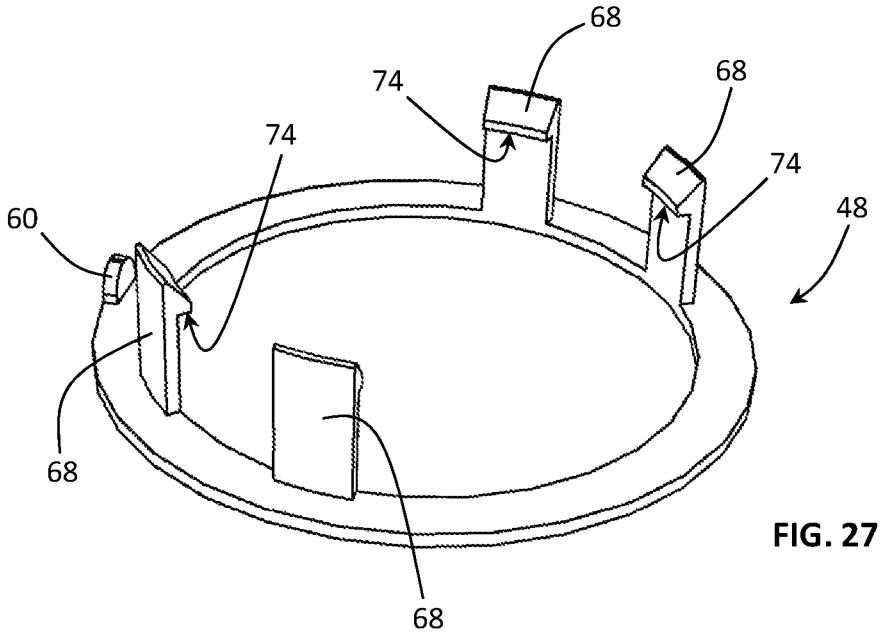
FIG. 27 is another perspective view of a lower locking ring of the system of FIG. 10.

Referring to FIGS. 23-25, in selected embodiments, a system 10 may be configured to detect when medication 12 is dispensed. This may ensure that an empty chute 34 is not rotated into alignment with an exit aperture 32 and counted as a dispensing of medication 12, which would deprive a patient of the benefit of the medication 12. Accordingly, in certain embodiments, a transport portion 28 may be rotated or pivoted through a range of motion that includes a load position 120 corresponding to an alignment with an entrance aperture 22, an intermediate position 124 corresponding to misalignment with both the entrance and exit apertures 22, 32, and an unload position 122 corresponding to an alignment with an exit aperture 32. A first sensor 26*a* may be positioned on a circuit board 112*b* so as to be proximate one end of the chute 34 when the transport portion 28 is in the load position 120. Accordingly, a sensor 26*a* may perceive through an interface 98 whether a tablet, capsule, or the like of the medication 12 is loaded within the chute 34.

Thus, in a dispensing operation, a user may press a button 56 to communicate his or her desire to receive a dose of medication 12. If it is an appropriate time to dispense a dose of the medication 12, a feedback device 58 may so indicate and a system 10 may prepare to dispense medication 12. Accordingly, the user may invert the system 10 and gently shake it until a tablet, capsule, or the like is loaded within a chute 34 of the transport portion 28.

When the control system detects via the sensor 26*a* that a tablet, capsule, or the like is loaded within the chute 34, the transport portion 28 may be moved (e.g., rotated or pivoted) to or through the intermediate position 124. As the transport portion 28 rests in or passes through the intermediate position 124, a second sensor 26*b* may perceive through an interface 98 whether a tablet, capsule, or the like of the medication 12 is loaded within the chute 34.

In the intermediate position 124, the chute 34 may be closed (or mostly or sufficiently closed) at both ends thereof. If a tablet or capsule of medication 12 is present within the chute 34 in the intermediate position 124, there may be no chance that the tablet or capsule will inadvertently fall back into the container 14. Accordingly, if a tablet or capsule of medication 12 is present within the chute 34 in the intermediate position 124, there may be no chance that an empty chute 34 is rotated into alignment with an exit aperture 32 and counted as a dispensing of medication 12.

If a second sensor 26*b* perceives through an interface 98 that a tablet, capsule, or the like of the medication 12 is not loaded within the chute 34, the control system may return the transport portion 28 to the load position 120. Thereafter, the process for loading and detecting a tablet or capsule within a chute 34 may be repeated. Conversely, if a second sensor 26*b* perceives through an interface 98 that a tablet, capsule, or the like of the medication 12 is loaded within the chute 34, the control system may move the transport portion 28 on to the unload position 122.

Figure 28:
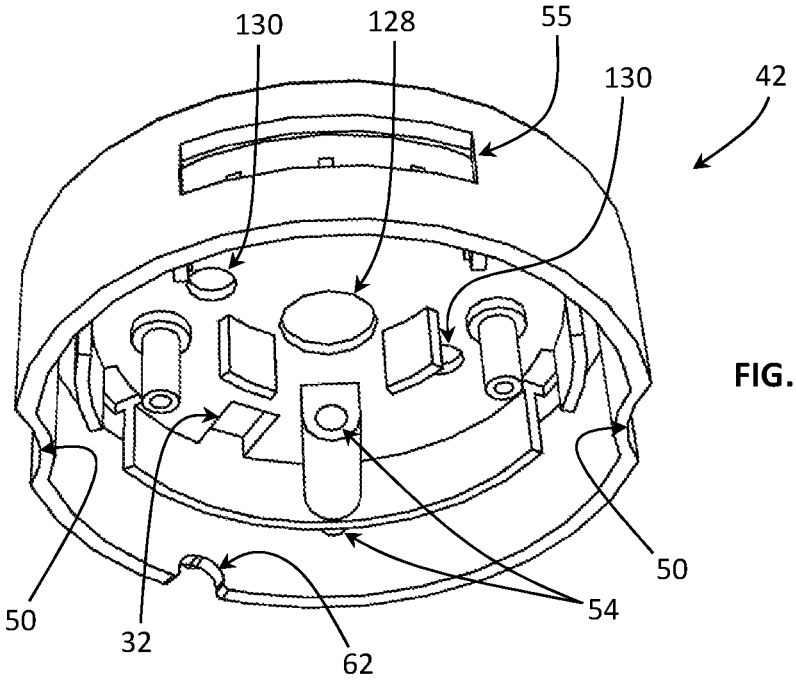
FIG. 28 is a perspective view of a main body of an outer cover of the system of FIG. 10.
Figure 29:
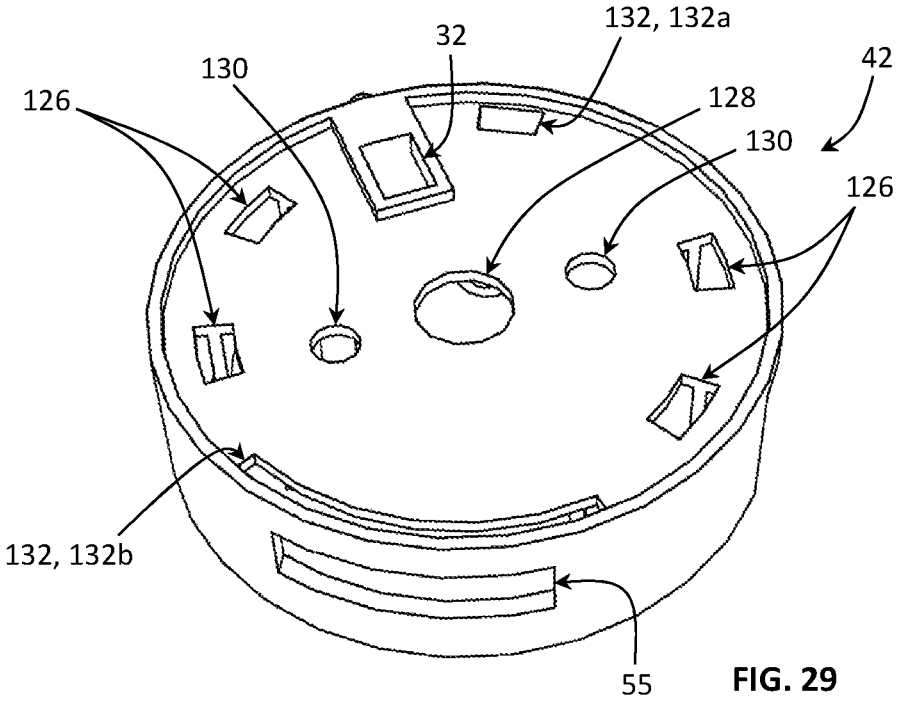
FIG. 29 is another perspective view of a main body of an outer cover of the system of FIG. 10.
Figure 30:
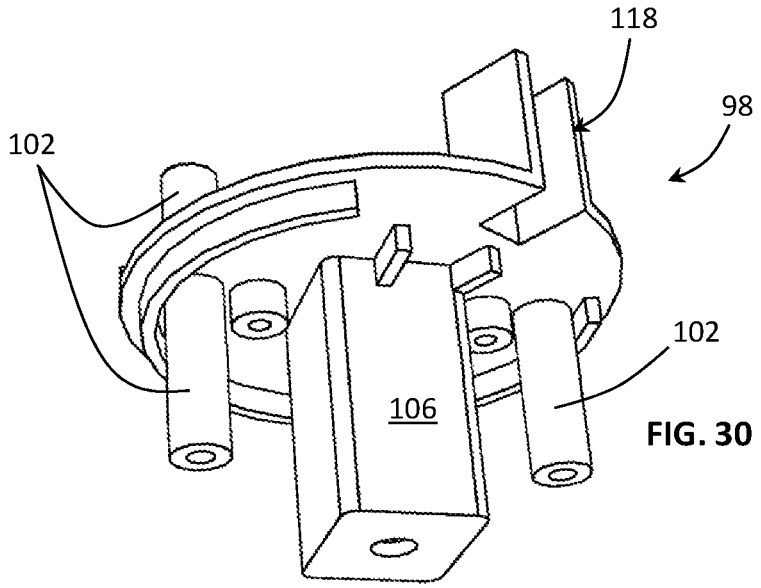
FIG. 30 is a perspective view of an interface of the system of FIG. 10.
Figure 31:
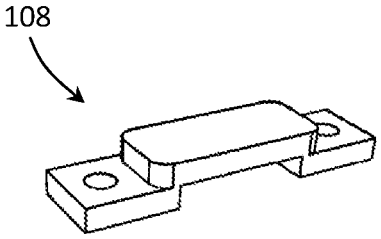
FIG. 31 is a perspective view of an actuator mount of the system of FIG. 10.
Figure 32:
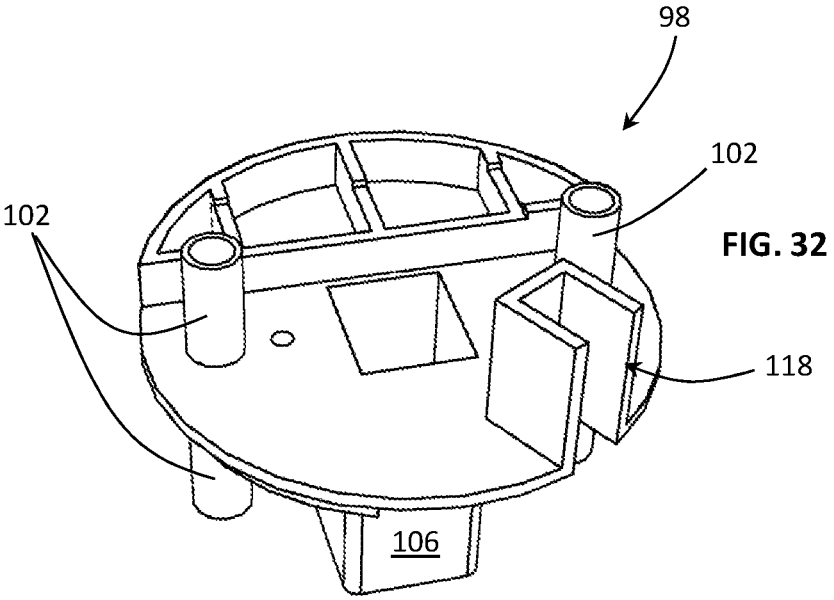
FIG. 32 is another perspective view of an interface of the system of FIG. 10.

Referring to FIGS. 28 and 29, in addition to an exit aperture 32, a top surface of a main body 42 of an outer cover 18 may have other apertures extending therethrough. For example, a top of a main body 42 may have one or more extension apertures 126, button apertures 128, feedback apertures 130, blocking apertures 132, or the like or combinations or sub-combinations thereof extending therethrough.

An extension aperture 126 may provide a location for a locking extension 72 and corresponding unlocking key 88 to pass through a main body 42. A button aperture 128 may provide a path for a button 56 of a user interface 44 to access a button 114 of a circuit board 112*a*. A feedback aperture 130 may provide a path for light from a light source on a circuit board 122*a* to reach a feedback device 58 of a user interface 44. A blocking aperture 132 may provide a location for a blocking extension 80 to pass through a main body 42. For example, a first blocking aperture 132*a* may provide a location for a first blocking extension 80*a* to pass through a main body 42 and a second blocking aperture 132*b* may provide a location for a second blocking extension 80*b* to pass through a main body 42.

Figure 33:
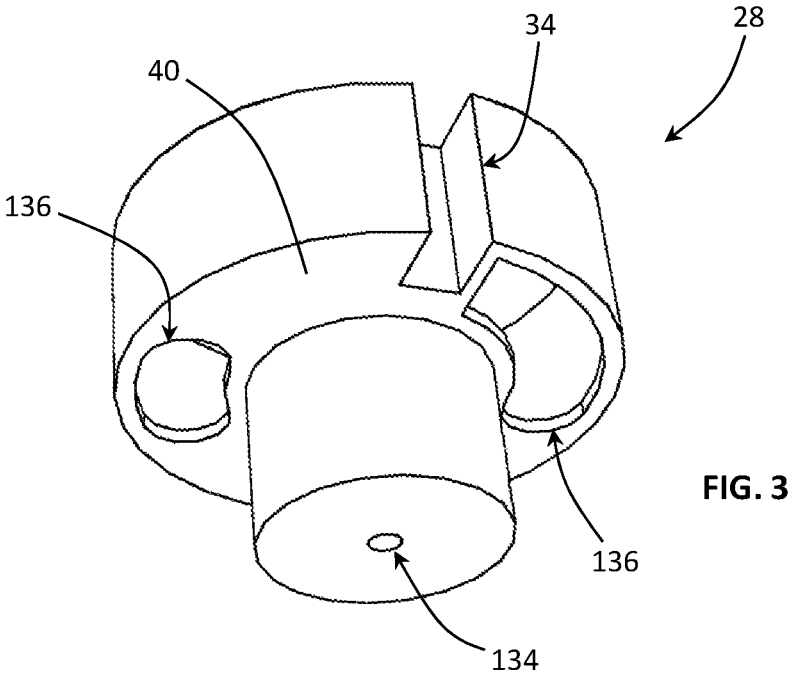
FIG. 33 is a perspective view of a transport portion of the system of FIG. 10.
Figure 34:
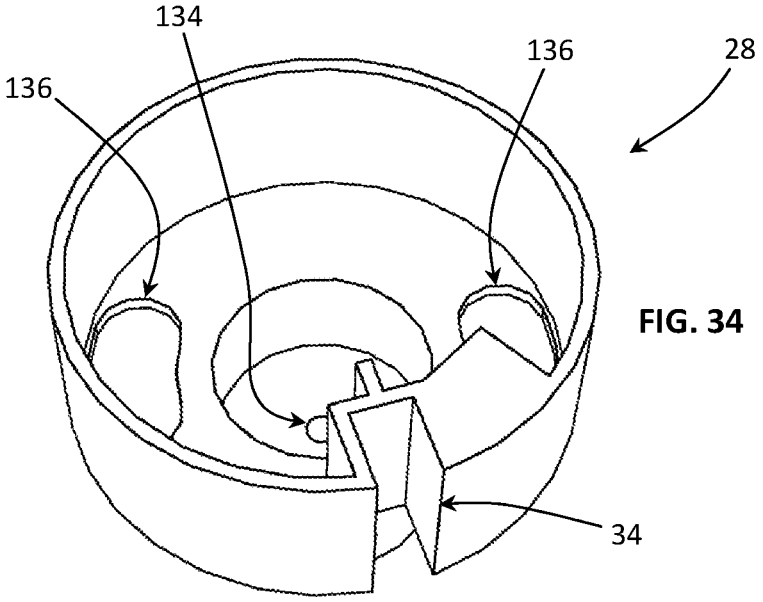
FIG. 34 is another perspective view of a transport portion of the system of FIG. 10.
Figure 35:
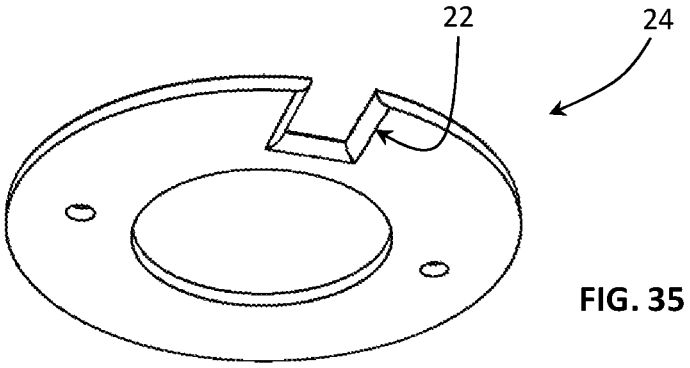
FIG. 35 is a perspective view of an inner cover of the system of FIG. 10.
Figure 36:
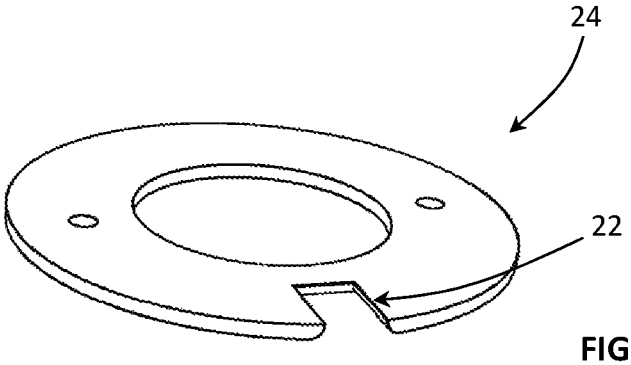
FIG. 36 is another perspective view of an inner cover of the system of FIG. 10.

Referring to FIGS. 33 and 34, a transport portion 28 may have selected apertures extending therethrough. For example, a transport portion 28 may have a shaft aperture 134 and one or more range-of-motion apertures 136 or the like or combinations thereof extending therethrough.

A shaft aperture 134 may provide a location for a shaft of an actuator 30 (e.g., a shaft of an electric motor) to engage a transport portion 28. In selected embodiments, a shaft aperture 134 may be keyed, include a flat surface, or the like in order to resist relative rotation with respect to a shaft of an actuator 30. Accordingly, a shaft aperture 134 (or selected bonding agents applied to a shaft aperture 134) may ensure that a transport portion 28 rotates or pivots with the shaft of an actuator 30.

A range-of-motion aperture 136 may enable posts 102 of an interface 98 to extend through a transport portion 28 to engage or support an inner cover 24. A range-of-motion aperture 136 may be elongated and curved in order to support a desired relative rotation of the posts 102 of an interface 98 with respect the transport portion 28.

In selected embodiments, abutment of a post 102 with an end of a corresponding range-of-motion aperture 136 may define an end or extreme of a range of motion of a transport portion 28 with respect to the outer and inner covers 18, 24 of a cap 16. That is, abutment of a post 102 with one end of a corresponding range-of-motion aperture 136 may correspond to a loading position 120 and abutment of the post 102 with the other end of the corresponding range-of-motion aperture 136 may correspond to an unloading position 122.

In certain embodiments, abutment of a post 102 with an end of a corresponding range-of-motion aperture 136 may trigger a control system to stop rotating a transport portion 28. For example, abutment of a post 102 with an end of a corresponding range-of-motion aperture 136 may trigger a spike in the current draw of an actuator 30 urging rotation of the transport portion 28. Accordingly, a control system may detect the spike in current draw and cut off the flow of electrical power to the actuator 30. Thus, abutment of a post 102 with an end of a corresponding range-of-motion aperture 136 may function as a limit switch on the motion of a transport portion 28.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method of dispensing a prescription medication, the method comprising:

obtaining a medication-dispensing system comprising a prescription vial having one open end, medication in the form of one or more tablets or capsules contained within the prescription vial, a cap closing off the one open end and enclosing the medication within the prescription vial, the cap comprising an outer cover having an exit aperture, an inner cover having an entrance aperture, and a transport portion having a chute, the cap wherein the chute of the transport portion is positioned between the outer cover and the inner cover, and a control system comprising a processor;

determining, by the processor, a first waiting period has passed;

dispensing, by the control system after the determining the first waiting period has passed, a first portion of the medication;

the dispensing the first portion comprising moving, by the control system, the transport portion with respect to the outer cover and the inner cover so that the chute of the transport portion moves out of alignment with the entrance aperture and into alignment with the exit aperture; and blocking, by the medication-dispensing system during the dispensing, manual access to the transport portion as the chute of the transport portion moves out of alignment with the entrance aperture and into alignment with the exit aperture.

2. The method of claim 1, wherein:

the prescription vial has an interior; and the transport portion is contained within the interior of the prescription vial.

3. The method of claim 1, wherein, during the dispensing, the outer cover is rotationally fixed with respect to the prescription vial, the inner cover is rotationally fixed with respect to the outer cover, and the control system selectively rotates the transport portion with respect to the inner and outer covers.

4. The method of claim 3, wherein the control system further comprises a motor positioned and connected to selectively induce rotation of the transport portion with respect to the inner and outer covers.

5. The method of claim 4, wherein the control system further comprises at least one sensor positioned proximate the chute.

6. The method of claim 5, further comprising sensing, by the at least one sensor after the determining the first waiting period has passed, a first tablet or capsule of the medication within the chute.

7. The method of claim 6, wherein the dispensing the first portion is initiated by the control system in response to the sensing the first tablet or capsule.

8. The method of claim 7, further comprising returning, by the control system after the dispensing the first portion, the chute of the transport portion into alignment with the entrance aperture.

9. The method of claim 8, further comprising determining, by the processor, a second waiting period has passed since the chute of the transport portion moved out of alignment with the entrance aperture and into alignment with the exit aperture.

10. The method of claim 9, further comprising:

dispensing, by the control system after the determining the second waiting period has passed, a second portion of the medication; and the dispensing the second portion comprising rotating, by the control system, the chute of the transport portion out of alignment with the entrance aperture and into alignment with the exit aperture.

11. The method of claim 10, further comprising sensing, by the at least one sensor after the determining the second waiting period has passed, a second tablet or capsule of the medication within the chute.

12. The method of claim 11, wherein the dispensing the second portion is initiated by the control system in response to the sensing the second tablet or capsule.

13. The method of claim 12, further comprising returning, by the control system after the dispensing the second portion, the chute of the transport portion into alignment with the entrance aperture.

14. A medication-dispensing system comprising a prescription vial having an interior, one open end, and one closed end located opposite the one open end;

a cap closing off the one open end;

the cap comprising an outer cover having an exit aperture, an inner cover having an entrance aperture, and a transport portion having a chute;

the cap wherein the inner cover is fixed with respect to the outer cover and the transport portion is contained within the interior of the prescription vial;

the cap wherein the chute of the transport portion is positioned between the outer cover and the inner cover;

a control system comprising a processor; and the control system controlling movement of the transport portion with respect to the outer and inner covers.

15. The system of claim 14, wherein the control system selectively moves the transport portion with respect to the inner and outer covers through a range of motion wherein one extreme of the range of motion corresponds to the chute being axially aligned with the entrance aperture and axially misaligned with the exit aperture and an opposite extreme of the range of motion corresponds to the chute being axially aligned with the exit aperture and axially misaligned with the entrance aperture.

16. The system of claim 14, further comprising an exterior and wherein the prescription vial and the outer cover contain the transport portion therewithin such that no portion of the exterior moves with respect to any other portion of the exterior as a result of the transport portion moving with respect to the outer and inner covers.

17. A medication-dispensing system comprising a prescription vial having an interior, one open end, and one closed end located opposite the one open end;

a cap closing off the one open end;

the cap comprising an outer cover having an exit aperture, an inner cover having an entrance aperture, and a transport portion having a chute;

the cap wherein the inner cover is fixed with respect to the outer cover;

the cap wherein the chute of the transport portion is (1) positioned between the outer cover and the inner cover and (2) contained within the interior of the prescription vial;

the cap wherein the transport portion selectively moves with respect to the inner and outer covers through a range of motion wherein one extreme of the range of motion corresponds to the chute being axially aligned with the entrance aperture and axially misaligned with the exit aperture and an opposite extreme of the range of motion corresponds to the chute being axially aligned with the exit aperture and axially misaligned with the entrance aperture;

a control system comprising a processor; and the control system controlling movement of the transport portion with respect to the outer and inner covers.

18. The system of claim 17, further comprising medication in the form of one or more tablets or capsules contained within the prescription vial, the medication having a prescription corresponding thereto.

19. The system of claim 17, further comprising an exterior and wherein the prescription vial and the outer cover contain the transport portion therewithin such that no portion of the exterior moves with respect to any other portion of the exterior as a result of the transport portion moving with respect to the inner and outer covers through the range of motion.

20. The system of claim 18, wherein:

the cap closes off the one open end and encloses the medication within the prescription vial; and the control system controls the movement of the transport portion with respect to the outer and inner covers to ensure that the medication is dispensed no faster than permitted by the prescription.

* * * * *